US008794003B2

(12) United States Patent
Mauran et al.

(10) Patent No.: US 8,794,003 B2
(45) Date of Patent: Aug. 5, 2014

(54) PLANT FOR PRODUCING COLD, HEAT AND/OR WORK

(75) Inventors: Sylvain Mauran, Millas (FR); Nathalie Mazet, Perpignan (FR); Pierre Neveu, St Michel de Llotes (FR); Driss Stitou, St Nazaire (FR)

(73) Assignee: Centre National de la Recherche Scientifique, Paris (FR)

( * ) Notice: Subject to any disclaimer, the term of this patent is extended or adjusted under 35 U.S.C. 154(b) by 978 days.

(21) Appl. No.: 12/935,474

(22) PCT Filed: Mar. 30, 2009

(86) PCT No.: PCT/FR2009/000365

§ 371 (c)(1),
(2), (4) Date: Feb. 14, 2011

(87) PCT Pub. No.: WO2009/144402

PCT Pub. Date: Dec. 3, 2009

(65) Prior Publication Data

US 2011/0167825 A1 Jul. 14, 2011

(30) Foreign Application Priority Data

Apr. 1, 2008 (FR) ..... 08 01786

(51) Int. Cl.

| | |
|---|---|
| ***F02G 1/04*** | (2006.01) |
| ***F01K 23/06*** | (2006.01) |
| ***F01K 13/00*** | (2006.01) |

(52) U.S. Cl.

USPC ..... 60/670; 60/645; 60/508

(58) Field of Classification Search

USPC ..... 60/325–494, 508–515, 645, 650, 651, 60/670, 671

See application file for complete search history.

(56) References Cited

U.S. PATENT DOCUMENTS

| | | | | | |
|---|---|---|---|---|---|
| 3,100,965 | A | * | 8/1963 | Blackburn | 60/375 |
| 3,608,311 | A | * | 9/1971 | Roesel | 60/516 |
| 3,611,723 | A | * | 10/1971 | Theis | 60/327 |
| 3,648,458 | A | * | 3/1972 | McAlister | 60/415 |
| 5,579,640 | A | * | 12/1996 | Gray et al. | 60/413 |

* cited by examiner

*Primary Examiner* — Kenneth Bomberg
*Assistant Examiner* — Christopher Jetton
(74) *Attorney, Agent, or Firm* — Sofer & Haroun, LLP

(57) ABSTRACT

A plant for the producing of cold, heat and/or work. The plant includes at least one modified Carnot machine having a first assembly that includes an evaporator Evap combined with a heat source, a condenser Cond combined with a heat sink, a device DPD for pressurizing or expanding a working fluid GT, a means for transferring said working fluid GT between the condenser Cond and DPD, and between the evaporator Evap and DPD; a second assembly that includes two transfer vessels CT and CT' that contain a transfer liquid LT and the working fluid GT in the form of liquid and/or vapor; a means for selectively transferring the working fluid GT between the condenser Cond and each of the transfer vessels CT and CT', as well as between the evaporator Evap and each of the transfer enclosures CT and CT'; and a means for selectively transferring the liquid LT between the transfer vessels CT and CT' and the compression or expansion device DPD, said means including at eat hydraulic converter.

30 Claims, 11 Drawing Sheets

PLANT FOR PRODUCING COLD, HEAT AND/OR WORK

RELATED APPLICATIONS

This application is a National Phase application of PCT/FR2009/000365, filed on Mar. 30, 2009, which in turn claims the benefit of priority from French Patent Application No. 08 01786, filed on Apr. 1, 2008, the entirety of which are incorporated herein by reference)

The present invention relates to a refrigeration, heat and/or work production plant.

TECHNOLOGICAL BACKGROUND

Thermodynamic machines used for refrigeration, heat production or energy production all refer to an ideal machine called the "Carnot machine". An ideal Carnot machine requires a heat source and a heat sink at two different temperature levels—it is therefore a "dithermal" machine. It is called a "driving" Carnot machine when it operates by delivering work and a "receiving" Carnot machine (also called a Carnot heat pump) when it operates by consuming work. In driving mode, the heat $Q_{hi}$ is delivered to a working fluid $G_T$ from a hot source at the temperature $T_{hi}$, the heat $Q_{lo}$ is yielded by the working fluid $G_T$ to a cold sink at the temperature $T_{lo}$ and the net work W is delivered by the machine. Conversely, in heat pump mode, the heat $Q_{lo}$ is taken by the working fluid $G_T$ to the cold source $T_{lo}$, the heat $Q_{hi}$ is yielded by the working fluid to the hot sink at the temperature $T_{hi}$ and the net work W is consumed by the machine.

According to the second law of thermodynamics, the efficiency of a dithermal (driving or receiving) machine, that is to say a real machine whether operating in the Carnot cycle or not, is at most equal to that of the ideal Carnot machine and depends only on the temperatures of the source and of the sink. However, the practical implementation of the Carnot cycle, consisting of two isothermal steps (at temperatures $T_{hi}$ and $T_{lo}$) and two reversible adiabatic steps, encounters a number of difficulties that have not been completely solved hitherto. During the cycle, the working fluid may still remain in the gaseous state or it may undergo a liquid/vapor change of state during the isothermal transformations at $T_{hi}$ and $T_{lo}$. When a liquid/vapor change of state occurs, the heat transfers between the machine and the environment take place with a higher efficiency than when the working fluid remains in the gaseous state. In the first case and for the same exchanged thermal power levels at the heat source and at the heat sink, the exchange areas are smaller (and therefore less expensive). However, when there is a liquid/vapor change of state, the reversible adiabatic steps consist in compressing and expanding a liquid/vapor two-phase mixture. The techniques of the prior art do not allow two-phase mixtures to be compressed or expanded. According to the current prior art it is not known how to carry out these transformations correctly.

To remedy this problem, it has been envisaged to approximate the Carnot cycle by isentropically compressing a liquid and isentropically expanding a superheated vapor (for a driving cycle) and by compressing the superheated vapor and isenthalpically expanding the liquid (for a receiving cycle). However, such modifications induce irreversibilities in the cycle and very significantly reduce its efficiency, that is to say the efficiency of the motor or the coefficient of performance or the coefficient of amplification of the heat pump.

GENERAL DEFINITION OF THE INVENTION

The object of the present invention is to provide a thermodynamic machine operating in a cycle close to the Carnot cycle, which is better than the machines of the prior art, that is to say a machine that operates with a liquid/vapor change of state of the working fluid in order to maintain the advantage of the low contact areas required, while still substantially limiting the irreversibilities in the cycle during the adiabatic steps.

One subject of the present invention is a refrigeration, heat and/or work production plant, comprising at least one modified Carnot machine. Another subject of the invention is a refrigeration, heat and/or work production process using a plant comprising at least one modified Carnot machine.

A refrigeration, heat or work production plant according to the present invention comprises at least one modified Carnot machine formed by:

a) a 1st assembly that comprises an evaporator Evap associated with a heat source, a condenser Cond associated with a heat sink, a device PED for pressurizing or expanding a working fluid $G_T$, means for transferring the working fluid $G_T$ between the condenser Cond and the PED and between the evaporator Evap and the PED;

b) a 2nd assembly that comprises two transfer chambers CT and CT' that contain a transfer liquid $L_T$ and the working fluid $G_T$ in liquid and/or vapor form, the transfer liquid $L_T$ and the working fluid being two different fluids;

c) means for the selective transfer of the working fluid $G_T$ between the condenser Cond and each of the transfer chambers CT and CT' on the one hand, and between the evaporator Evap and each of the transfer chambers CT and CT' on the other; and d) means for the selective transfer of the liquid $L_T$ between the transfer chambers CT and CT' and the compression or expansion device PED, said means comprising at least one hydraulic converter.

In the present text:

"modified Carnot cycle" means a thermodynamic cycle comprising the steps of the theoretical Carnot cycle or similar steps with a degree of reversibility of less than 100%;

"modified Carnot machine" denotes a machine having the above features a), b), c) and d);

"hydraulic converter" denotes either a hydraulic pump or a hydraulic motor;

"hydraulic pump" denotes a device that uses mechanical energy delivered by the environment to the "modified Carnot machine" to pump a hydraulic transfer fluid $L_T$ at low pressure and to restore it at higher pressure;

"auxiliary hydraulic pump" denotes a device that uses mechanical energy delivered by the environment to the "modified Carnot machine" or taken from the work delivered to the environment by the "modified Carnot machine" to pressurize either the transfer liquid $L_T$ or the working fluid $G_T$ in the liquid state;

"hydraulic motor" denotes a device that delivers mechanical energy generated by the modified Carnot machine to the environment by depressurizing the transfer liquid $L_T$ at high pressure and restoring it at lower pressure;

"environment" denotes any element external to the modified Carnot machine, including heat sources and sinks and any element of the plant to which the modified Carnot machine is connected;

"reversible transformation" means a transformation that is reversible in the strict sense, and also a quasi-reversible transformation. The sum of the variations in entropy of the fluid that undergoes the transformation and of the environment is zero during a strictly reversible transformation corresponding to the ideal case, and slightly positive during an actual, quasi-reversible transformation. The degree of reversibility of a cycle may be quantified by the ratio of the efficiency (or the coefficient of performance COP) of the cycle to the efficiency of the Carnot cycle operating between the same extreme temperatures. The greater the reversibility of the cycle, the closer this ratio is to 1 (the ratio always being less than 1);

"isothermal transformation" means a strictly isothermal transformation or one under conditions close to the theoretical isothermal nature, recognizing that, under actual operating conditions, during a transformation considered to be isothermal carried out cyclically, the temperature T undergoes slight variations, such that ΔT/T is ±10%; and "adiabatic transformation" means a transformation with no heat exchange with the environment, or with heat exchange that it is endeavored to minimize by thermally isolating the fluid that undergoes the transformation and the environment.

The refrigeration, heat and/or work production process according to the invention consists in making a working fluid $G_T$ undergo a succession of modified Carnot cycles in a plant according to the invention comprising at least one modified Carnot machine. A modified Carnot machine comprises the following transformations:

an isothermal transformation with heat exchange between $G_T$ and the heat source, or between $G_T$ and the heat sink;

an adiabatic transformation with a reduction in the pressure of the working fluid $G_T$, an isothermal transformation with heat exchange between $G_T$ and the heat sink, or between $G_T$ and the heat source; and an adiabatic transformation with an increase in the pressure of the working fluid $G_T$.

The process is characterized in that:

the working fluid is in a liquid-gas two-phase form at least during the two isothermal transformations of a cycle; and the two isothermal transformations produce or are produced by a change in volume of $G_T$ concomitant with the displacement of a transfer liquid $L_T$ that drives or is driven by a hydraulic converter, and as a consequence, work is delivered or received by the plant by means of a hydraulic fluid which flows through a hydraulic converter during at least the two isothermal transformations.

In one embodiment, the work is received or delivered by the plant via a hydraulic fluid which flows through a hydraulic converter during just one of the adiabatic transformations. In this embodiment, the modified Carnot cycle and the modified Carnot machine are referred to as being "of the 1st type".

In one embodiment, the work is received or delivered by the plant via a hydraulic fluid which flows through a hydraulic converter during both adiabatic transformations. In this embodiment, the modified Carnot cycle and the modified Carnot machine are referred to as "of the 2nd type".

DESCRIPTION OF THE DRAWINGS

FIG. 12*a* shows an embodiment of thermal coupling at an intermediate temperature level between two modified driving Carnot machines. FIG. 12*b* shows another embodiment with a single modified driving Carnot machine.

DETAILED DESCRIPTION OF THE INVENTION

Figure 1:
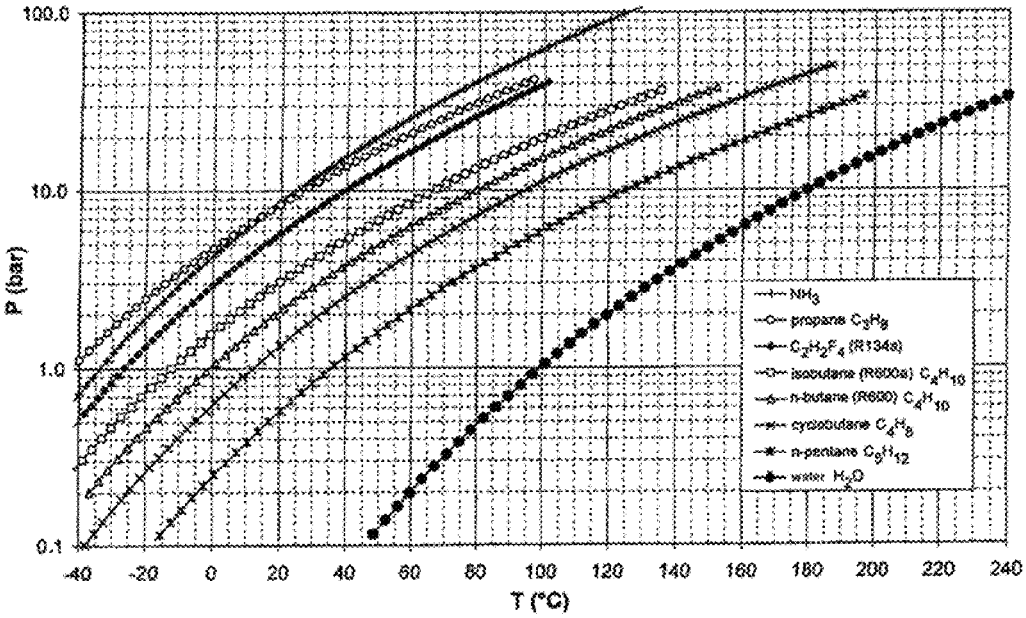
FIG. 1 shows the liquid/vapor equilibrium curves for various fluids that can be used as working fluid $G_T$. The saturation vapor pressure P (in bar) is plotted on the y-axis, on a logarithmic scale, as a function of the temperature T (in ° C.) plotted on the x-axis.

In a plant according to the present invention, a modified Carnot machine may have a driving machine configuration or a receiving machine configuration. In both cases, the machine may be of the 1st type (work exchange between the transfer liquid and the environment during one of the adiabatic transformations) or of the 2nd type (work exchange between the transfer liquid and the environment during both adiabatic transformations). A modified Carnot machine may also have a configuration that allows, depending on the choice of the user, operation in driving (1st or 2nd type) mode or in receiving (1st or 2nd type) mode.

The process for controlling a driving machine comprises at least one step during which heat is supplied to the plant, with a view to recovering work during at least one of the transformations of the modified Carnot cycle. The process for controlling a receiving machine comprises at least one step during which work is supplied to the plant, with a view to recovering heat at the hot sink $T_{hi}$ or removing heat at the cold source at $T_{lo}$ during at least one of the isothermal transformations of the modified Carnot cycle.

The process according to the present invention consists in subjecting a working fluid $G_T$ to a succession of cycles between a heat source and a heat sink. In what follows, for the sake of simplification and because this does not affect the operating principle of the modified Carnot machine, no distinction is made between the temperature of the hot source or sink and that of the working fluid that exchanges with this source or sink, these temperatures being denoted by $T_h$. Likewise, no distinction is made between the temperature of the cold source or sink and that of the working fluid that exchanges with this source or sink, these temperatures being denoted by $T_{lo}$. Thus, any heat exchange is considered to be perfect.

The working fluid $G_T$ and the transfer liquid $L_T$ are preferably chosen in such a way that $G_T$ is weakly soluble, preferably insoluble, in $L_T$, $G_T$ does not react with $L_T$, and in the liquid state $G_T$ is less dense than $L_T$. When the solubility of $G_T$ in $L_T$ is too high or if $G_T$ in the liquid state is denser than $L_T$, it is necessary to isolate them from each other by a means that does not prevent work exchange. Said means may consist for example in interposing a flexible membrane between $G_T$ and $L_T$ which creates an impermeable barrier between the two fluids but which offers only very slight resistance to the displacement of the transfer liquid and slight resistance to heat transfer. Another solution is formed by a float that has a density intermediate between that of the working fluid $G_T$ in the liquid state and that of the transfer liquid $L_T$. A float may constitute a large physical barrier, but it is difficult to make it perfectly effective if it is desired for there to be no friction on the side walls of the chambers CT and CT'. On the other hand, the float may constitute a very effective thermal resistance. The two solutions (membrane and float) may be combined.

The transfer liquid $L_T$ is chosen from liquids that have a low saturation vapor pressure at the operating temperature of the plant so as to avoid, in the absence of a separating membrane as described above, limitations due to diffusion of the $G_T$ vapor through the $L_T$ vapor at the condenser or at the evaporator. Provided that there is the abovementioned compatibility with $G_T$, nonexhaustive examples of $L_T$ may be water or a mineral oil or a synthetic oil, preferably one having a low viscosity.

The working fluid $G_T$ undergoes transformations in the temperature/pressure thermodynamic domain preferably compatible with liquid-vapor equilibrium, that is to say between the melting point and the critical temperature. However, during the modified Carnot cycle some of these transformations may occur completely or partly in the supercooled liquid or superheated vapor domain, or the supercritical domain. Preferably, a working fluid is chosen from pure substances and azeotropic mixtures so as to have a one-variable relationship between temperature and pressure at liquid-vapor equilibrium. However, a modified Carnot machine according to the invention may also operate with a nonazeotropic solution as working fluid.

The working fluid $G_T$ may for example be water, $CO_2$, or $NH_3$. The working fluid may also be chosen from alcohols containing 1 to 6 carbon atoms, alkanes containing 1 to 18 (more particularly 1 to 8) carbon atoms, chlorofluoroalkanes preferably containing 1 to 15 (more particularly 1 to 10) carbon atoms and partially or completely fluorinated or chlorinated alkanes preferably containing 1 to 15 (more particularly 1 to 10) carbon atoms. In particular, mention may be made of 1,1,1,2-tetrafluoroethane, propane, isobutane, n-butane, cyclobutane, and n-pentane. FIG. 1 shows the liquid/vapor equilibrium curves for a few of the aforementioned fluids $G_T$. The saturation vapor pressure P (in bar) is plotted on a logarithmic scale on the y-axis as a function of the temperature T (in ° C.) plotted on the x-axis.

A fluid that can be used as working fluid may act as driving fluid or as receiving fluid, depending on the plant in which it is used, on the available heat sources and on the desired objective.

In general, the working fluids and transfer liquids are firstly chosen according to the available heat source and heat sink temperatures and the desired maximum or minimum saturation vapor pressures in the machine, and then according to other criteria, such as especially toxicity, environmental impact, chemical stability and cost.

The fluid $G_T$ in the chambers CT or CT' may be in the liquid/vapor two-phase mixture state after the adiabatic expansion step in the case of the driving cycle or after the adiabatic compression step in the case of the receiving cycle. In this case, the liquid phase of $G_T$ accumulates at the $G_T/L_T$ interface. When the vapor content of $G_T$ is high (typically between 0.95 and 1) in the chambers CT or CT' before said chambers are connected with the condenser, it is conceivable for the liquid phase of $G_T$ in these chambers to be completely eliminated. This elimination may be carried out while maintaining the temperature of the working fluid $G_T$ in the chambers CT or CT' at the end of the steps of bringing the chambers CT or CT' into communication with the condenser, at a value above that of the working fluid $G_T$, in the liquid state in the condenser, so that there is no liquid $G_T$ in CT or CT' at this moment.

In one embodiment, the plant comprises means for heat exchange between, on the one hand, the heat source and the heat sink, which are at different temperatures, and, on the other hand, the evaporator Evap, the condenser Cond and possibly the working fluid $G_T$ in the transfer chambers CT and CT'.

When the hydraulic converter of the modified Carnot machine is a hydraulic motor and the temperature of the source is above the temperature of the sink, the modified Carnot machine is a driving machine. A plant according to the present invention may comprise a single modified driving Carnot machine, or such a machine coupled to a complementary device, depending on the intended objective. The coupling may be achieved thermally or mechanically.

In a modified driving Carnot machine of the 1st type, the device PED consists of a device that pressurizes the working fluid $G_T$ in the saturated liquid or supercooled liquid state, for example an auxiliary hydraulic pump $AHP_1$.

In a modified driving Carnot machine of the 2nd type, the pressurization or expansion device PED comprises, on the one hand, a compression/expansion chamber ABCD and the transfer means associated therewith and, on the other hand, an auxiliary hydraulic pump $AHP_2$ that pressurizes the hydraulic transfer fluid $L_T$.

In a process according to the invention implemented according to a modified driving Carnot cycle, the cycle comprises the following transformations:

an isothermal transformation during which heat is delivered to $G_T$ from the heat source at the temperature $T_{hi}$;

an adiabatic transformation with a reduction in the pressure of the working fluid $G_T$;

an isothermal transformation during which heat is delivered by $G_T$ to the heat sink at the temperature $T_{lo}$ below the temperature $T_{hi}$; and an adiabatic transformation with an increase in the pressure of the working fluid $G_T$.

When the process of the invention is a succession of modified driving Carnot cycles, the heat source is at a temperature above the temperature of the heat sink. Each cycle is formed by a succession of steps during which there is a change in volume of the working fluid $G_T$. This variation in volume causes a displacement of the liquid $L_T$ that drives a hydraulic motor or is caused by a displacement of the liquid $L_T$ which is driven by an auxiliary hydraulic pump. Thus, the plant consumes work during certain steps and this is recovered during other steps, whereas over the complete cycle there is a net production of work to the environment. The environment may be an ancillary device that transforms the work delivered by the plant to electricity, to heat or to refrigeration power. A process for operating a modified driving Carnot machine is described in greater detail on the basis of the machine shown schematically in FIG. 2.

Figure 2:
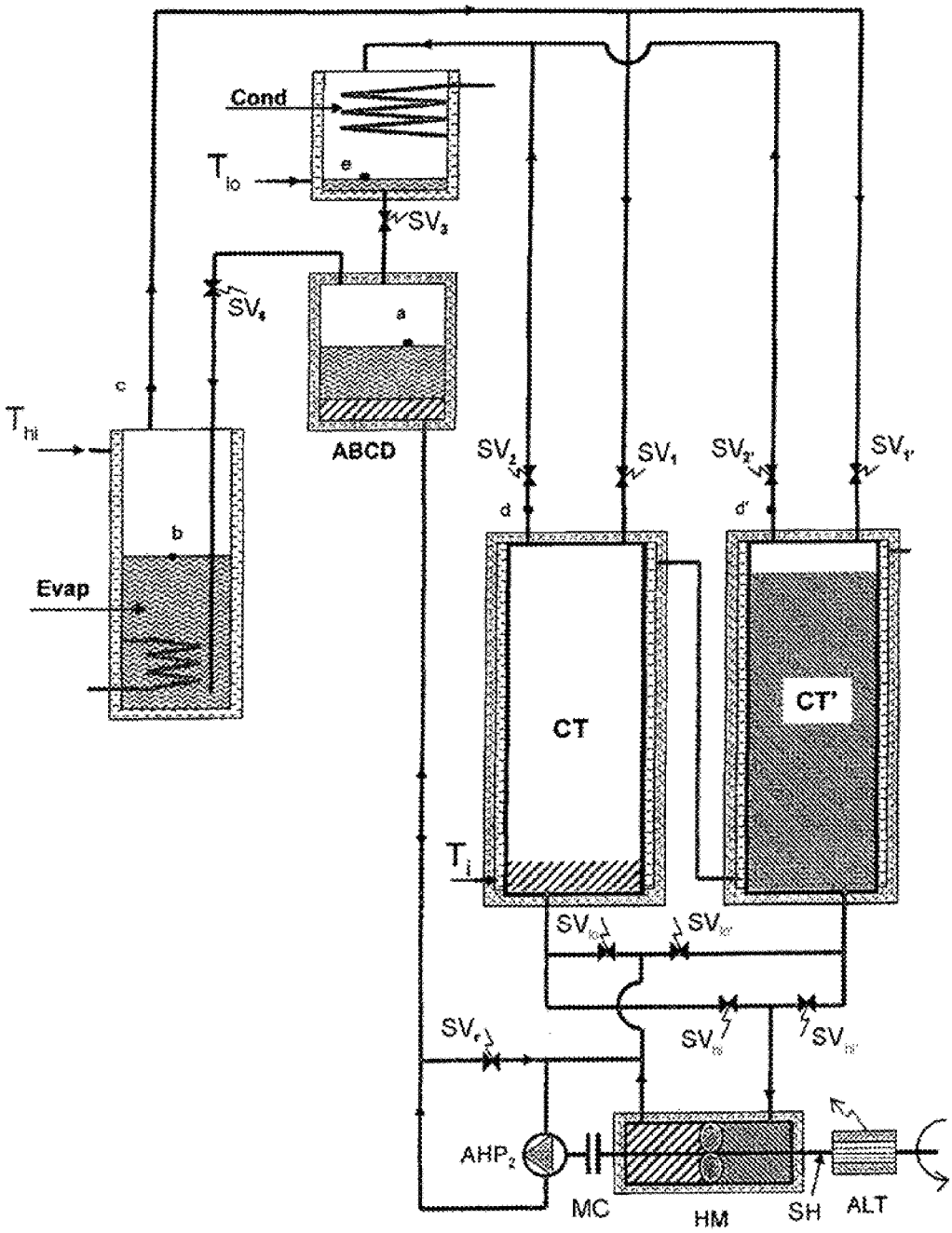
FIG. 2 shows a schematic view of a modified driving Carnot machine of the 2nd type.

FIG. 2 shows a schematic view of a modified driving Carnot machine of the 2nd type that comprises an evaporator Evap, a condenser Cond, an isentropic compression/expansion chamber ABCD, a hydraulic motor HM, an auxiliary hydraulic pump $AHP_2$ and two transfer chambers CT and CT'. These various elements are connected together by a first circuit containing exclusively the working fluid $G_T$ and a second circuit containing exclusively the transfer liquid $L_T$. Said circuits comprise various branches that can be closed off by controlled valves.

The evaporator Evap and the condenser Cond contain exclusively the fluid $G_T$, in general in the liquid/vapor mixture state. However, depending on the working fluid $G_T$ and the temperature of the hot source $T_{hi}$, said working fluid $G_T$ may be in the supercritical domain at said temperature $T_{hi}$ and, under these conditions, the evaporator Evap contains $G_T$ only in the gaseous state. It is the liquid $L_T$ that passes exclusively through the motor HM and the pump $AHP_2$. The elements ABCD, CT and CT' constitute the interfaces between the two ($G_T$ and $L_T$) circuits and they contain the hydraulic transfer fluid $L_T$ in the bottom portion and/or the working fluid $G_T$ in the liquid, vapor or liquid/vapor mixture state in the upper portion.

ABCD is connected to Cond and to Evap by circuits containing $G_T$ that can be closed off by the solenoid valves $SV_3$ and $SV_4$ respectively. Evap is connected to CT and CT' by circuits containing $G_T$ that can be closed off by the solenoid valves $SV_1$ and $SV_{1'}$ respectively. Cond is connected to CT and CT' by circuits containing $G_T$ that can be closed off by the solenoid valves $SV_2$ and $SV_2$ respectively. In the embodiment shown in FIG. 2, the closure means are two-way solenoid valves. However, other types of valves, whether controlled or not, may be used, especially pneumatic valves, slide valves or nonreturn valves. Certain pairs of two-way valves (i.e. having an inlet and an outlet) may be replaced with three-way valves (having one inlet, two outlets, or two inlets and one outlet). Other possible valve combinations are within the competence of a person skilled in the art.

In the embodiment shown in FIG. 2, the liquid passing through the hydraulic motor always flows in the same direction. In this embodiment, which is the most frequent one for a hydraulic motor, the high-pressure transfer liquid $L_T$ is always connected to the motor HM at the same inlet (on the right in FIG. 2) and the low-pressure transfer liquid $L_T$ is always connected to the motor HM at the same outlet (on the left in FIG. 2). Since the chambers CT and CT' are alternately at high pressure and at low pressure, a set of solenoid valves serves for connecting them to the appropriate inlet/outlet of the motor HM. Thus, the hydraulic motor HM is connected on the inlet (or upstream) side to CT and CT' by a circuit containing high-pressure $L_T$ that can be closed off by the solenoid valves $SV_{hi}$ and $SV_{hi'}$ respectively, and is connected on the outlet (or downstream) side to CT and CT' by a circuit containing low-pressure $L_T$ that can be closed off by the solenoid valves $SV_{lo}$ and $SV_{lo'}$ respectively. For example in the step of the cycle shown in FIG. 2, the high pressure is in the chamber CT' and the low pressure in CT; the solenoid valves $SV_{hi'}$ and $SV_{lo}$ are open and the solenoid valves $SV_{hi}$ and $SV_{lo}$ are closed, the transfer liquid flowing through HM from right to left. During the other half of the cycle, the high pressure is in CT and the low pressure is in CT', the solenoid valves $SV_{hi'}$ and $SV_{lo}$ are closed and the solenoid valves $SV_{hi}$ and $SV_{lo'}$ are open, but the transfer liquid passes through the hydraulic motor in the same direction (from right to left).

ABCD is connected in its lower portion to the downstream end of HM by a circuit containing the transfer liquid $L_T$ and comprising, in two parallel branches, the auxiliary hydraulic pump $AHP_2$ and the solenoid valve $SV_r$. When $L_T$ flows from HM to ABCD, it is pressurized by $AHP_2$ and $SV_r$ is closed. When $L_T$ flows from ABCD to MH, it flows under gravity, $SV_r$ is open and $AHP_2$ is stopped. Since the transfer liquid $L_T$ is finally transferred to CT or CT', it is necessary for ABCD to be above the chambers CT and CT'.

In FIG. 2, the shaft SH of the hydraulic motor HM is connected to a receiver (i.e. a work-consuming element), either directly or via a conventional coupling. The receiver is an alternator ALT coupled directly to the shaft of the hydraulic motor, and the auxiliary hydraulic pump $AHP_2$ is connected via a magnetic clutch MC. Other coupling modes, such as a universal joint, a belt or a magnetic or mechanical clutch, may be used. Likewise, other receivers may be connected onto the same shaft, for example a water pump, a modified receiving Carnot machine, or a conventional heat pump (with mechanical vapor compression). If necessary, a flywheel may also be mounted on this shaft to promote the concatenation of the receiving and driving steps of the cycle.

Figure 3:
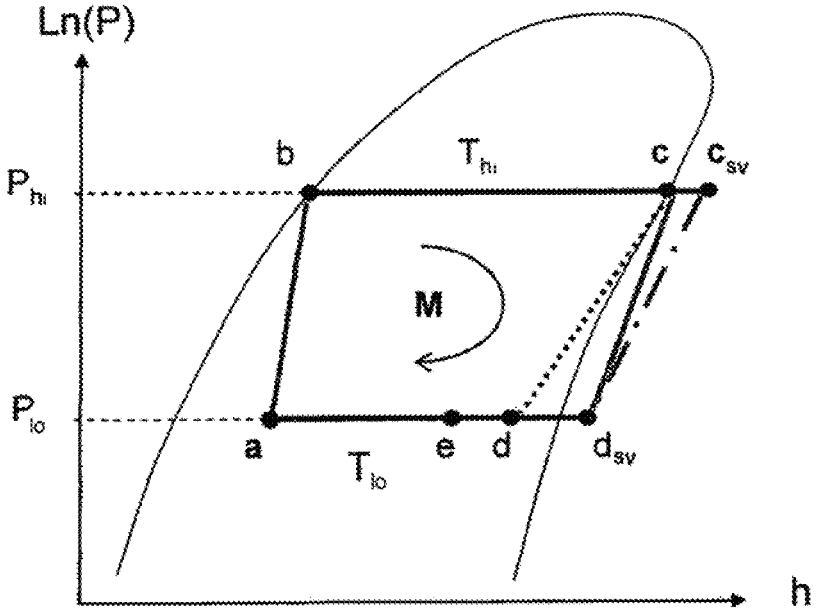
FIG. 3 shows, in a Mollier diagram used by refrigeration engineers, a modified driving Carnot cycle followed by a working fluid $G_T$. The pressure P is plotted on a logarithmic scale as a function of the enthalpy per unit mass h of the working fluid.

A modified Carnot cycle may be described in the Mollier diagram used by refrigeration engineers, in which the pressure P is plotted on a logarithmic scale as a function of the enthalpy per unit mass h of the working fluid. FIG. 3 shows the Mollier diagram of the modified driving Carnot cycle followed by the working fluid $G_T$.

Depending on the fluid $G_T$ used, the step of isentropically expanding the saturated vapor at the outlet of the evaporator may result in a two-phase mixture or in superheated vapor. In FIG. 3, the two-phase mixture case is shown by the path between the points "c" and "d" shown as a dotted line and the superheated vapor case is shown by the path between the points "c" and "$d_{sv}$" shown as the solid line. Furthermore, whatever $G_T$ is, the vapor at the outlet of the evaporator may be superheated in such a way that, after the isentropic expansion, there is only superheated vapor or vapor at the saturation limit. This 3rd case is shown in FIG. 3 by the path between the points "$c_{sv}$" and "$d_{sv}$" shown as the dash-dot line. Any incursion at the start or end of the isentropic expansion in the superheated vapor domain generates irreversibilities and therefore results in a reduction in efficiency of the cycle. However, when the position of the point "d" is very close to the saturated vapor stage, it is preferable to eliminate any liquid $G_T$ in the chambers CT or CT' by superheating $G_T$ after the isentropic expansion. The choice of means for heating $G_T$ in CT and CT' is within the competence of a person skilled in the art. The heat may for example be supplied by an electrical resistance element or by exchange with the hot source at $T_{hi}$. The heat exchange may take place in a heat exchanger integrated into the $L_T$ circuit, said $L_T$ exchanging heat in turn with $G_T$ at their interface in CT and CT'. The heat exchange may also take place at the side walls of CT and CT'. It is the latter possibility that is shown in FIG. 2, in which the heat at the temperature $T_i$ is supplied to $C_T$.

The modified driving Carnot cycle is formed by four successive phases starting at times $t_\alpha$, $t_\gamma$, $t_\delta$ and $t_\lambda$ respectively. This is described below with reference to the a-b-c-$d_{sv}$-e-a cycle of the Mollier diagram shown in FIG. 3. The principle is the same for the a-b-$c_{sv}$-$d_{sv}$-e-a cycle.

αβγ Phase (Between the Times $t_\alpha$, and $t_\gamma$):

At the time immediately preceding $t_\alpha$, the level of $L_T$ is low (denoted by L) in ABCD and the cylinder CT, and is high (denoted by H) in the cylinder CT'. At the same instant, the saturation vapor pressure of $G_T$ has a low value $P_{lo}$ in ABCD and CT and a high value $P_{hi}$ in Evap and CT'. It is this instant of the cycle that the configuration of the plant shown schematically in FIG. 2 corresponds to.

At time $t_\alpha$, the opening of the solenoid valves $SV_{lo'}$, $SV_2$, $SV_{hi'}$ and $SV_{lo}$ and the engagement of the $AHP_2$ cause the following effects:

- the saturated $G_T$ vapor leaving the evaporator at $P_{hi}$ penetrates CT' and delivers the transfer liquid $L_T$ to an intermediate level (denoted by J). $L_T$ passes through the motor HM, expanding therein and producing work, a portion of which is recovered by the pump $AHP_2$;
- after having been expanded by HM, a portion of the transfer liquid $L_T$ is transferred to CT and the other portion of the liquid $L_T$ is transferred to ABCD. In CT, the $L_T$ passes from the low level to the intermediate level (denoted by I), and discharges the $G_T$ vapor into the condenser, where it condenses and accumulates in the bottom portion (the valve $SV_2$ being open and the valve $SV_3$ being closed). The other portion of $L_T$ is taken in by the pump $AHP_2$ and discharged at a higher pressure into ABCD, thereby enabling the liquid/vapor $G_T$ mixture contained in this chamber to be isentropically compressed.

In the Mollier diagram (FIG. 3), this step corresponds to the following simultaneous transformations:

a→b in the chamber ABCD;

b→c in the Evap-CT' assembly;

$d_{sv}$→e in the CT-Cond assembly.

The pressurization of $G_T$ from the low pressure $P_{lo}$ up to the high pressure $P_{hi}$ in ABCD must be carried out before it is introduced into the evaporator, which is still at the high pressure $P_{hi}$. It is therefore only at the time $t_\beta$ that the solenoid valve $SV_4$ (which may be replaced by a nonreturn valve) between ABCD and Evap is opened. This requires there to be a stock of $G_T$ in the liquid state in the evaporator at the start of this phase, which stock is reconstituted at the end of this step.

From an energy standpoint, during this αβγ phase, heat $Q_{hi}$ has been consumed at the evaporator at $T_{hi}$, heat $Q_{lo}$, has been released at the condenser at $T_{lo}$ ($T_{lo}<T_{hi}$) and a net work $W_{\alpha\beta\gamma}$ has also been delivered to the outside.

γδ Phase (Between Times $t_\gamma$ and $t_\delta$):

At time $t_\gamma$, that is to say when the level of $L_T$ has reached the predefined values (I in CT, J in CT' and H in ABCD), the valves $SV_2$, $SV_{lo}$ and $SV_{hi'}$ are left open and the solenoid valves $SV_3$ and $SV_r$ are opened. As a result:

- the $G_T$ vapor contained in CT' continues to expand, but quasi-adiabatically (c→d→$d_{sv}$ transformation in the Mollier diagram of FIG. 3) and again discharges the transfer liquid $L_T$ through the motor HM into the cylinder CT. In fact, this transformation may be decomposed into a strictly adiabatic expansion (c→d) which ends up, depending on the fluid $G_T$, in the two-phase domain or in the superheated vapor, followed by a slight superheating (d→$d_{sv}$) via the walls of CT' that are kept at a temperature sufficient to permit this (between $T_{lo}$ and $T_{hi}$). The transformation d→$d_{sv}$ is not essential; if after the strictly adiabatic expansion (c→d) the fluid $G_T$ is in the two-phase domain, the liquid $G_T$ will be partially discharged at the end of this γδ phase into the condenser; the chamber ABCD in communication with the condenser is brought back down to the low pressure and the transfer liquid $L_T$ that it contains in its lower portion flows under gravity into CT, which must therefore be preferably beneath ABCD. However if the solenoid valve $SV_r$ is opened slightly before the solenoid valve $SV_3$ and if a small amount of $G_T$ remains in the saturated liquid state in the upper portion of ABCD, then the depressurization of $L_T$ during the step of communicating with CT causes the remainder of said liquid $G_T$ initially at the high pressure $P_{hi}$ to be partially or completely vaporized. Under these conditions, the pressure upstream of $SV_r$ may be sufficient throughout the duration of $L_T$ transfer so as to compensate for the liquid column height, and the chamber ABCD is then not necessarily above the chambers CT and CT';
- because of the rise in the level of $L_T$ (from 1 to H) in CT, the remainder of the $G_T$ vapor in CT condenses in Cond (e→a transformation); and
- all the condensates (those accumulated during the preceding phase and those of the present phase) are in ABCD.

From an energy standpoint, during this γδ phase, heat $Q_{ea}$ is released at the condenser at $T_{lo}$, a little heat (taken from the hot source at $T_{hi}$) is possibly consumed in CT' to provide the d→$d_{sv}$ superheating and work $W_{\beta\gamma}$ is also delivered to the outside.

The second portion of the cycle is symmetric: the evaporator, the condenser and ABCD are the sites of the same successive transformations, whereas the roles of the chambers CT and CT' are reversed.

δελ Phase (Between Times $t_\delta$ and $t_\lambda$):

This phase is equivalent to the αβγ phase but with the transfer chambers CT and CT' reversed.

λα Phase (Between Times $t_\lambda$ and $t_\alpha$):

This phase is equivalent to the γδ phase but with the transfer chambers CT and CT' reversed.

After the λα phase, the modified driving Carnot machine of the 2nd type is in the α state of the cycle described above. The various thermodynamic transformations followed by the fluid $G_T$ (with the d→+$d_{sv}$ transformation considered as optional) and the levels of the transfer liquid $L_T$ are given in Table 1. The states of the actuators (solenoid valves and clutch of the pump $AHP_2$) are given in Table 2, in which x indicates that the corresponding solenoid valve is open or that the pump $AHP_2$ is engaged.

TABLE 1

| Step | Transformation | Location | $L_T$ level CT | CT' | ABCD |
|---|---|---|---|---|---|
| αβγ | a → b | ABCD | L→I | H→J | L→H |
| | b → c | Evap + CT' | | | |
| | d or $d_{sv}$ → e | CT + Cond | | | |
| γδ | c → d or $d_{sv}$ | CT' | I→H | J→L | H→L |
| | e → a | CT + Cond + ABCD | | | |
| δελ | a → b | ABCD | H→J | L→I | L→H |
| | b → c | Evap + CT | | | |
| | d or $d_{sv}$ → e | CT' + Cond | | | |
| λα | c → d or $d_{sv}$ | CT | J→L | I→H | H→L |
| | e → a | CT' + Cond + ABCD | | | |

TABLE 2

| Step | $SV_1$ | $SV_{1'}$ | $SV_2$ | $SV_{2'}$ | $SV_3$ | $SV_4$ | $SV_{lo}$ | $SV_{hi}$ | $SV_{lo'}$ | $SV_{hi'}$ | $SV_r$ | $AHP_2$ |
|---|---|---|---|---|---|---|---|---|---|---|---|---|
| αβγ | | x | x | | | x(to $t_\beta$) | x | | | x | | x |
| γδ | | | x | | x | | x | | | x | x | |
| δελ | X | | | x | | x (to $t_\epsilon$) | | x | x | | | x |
| λα | | | | x | x | | | x | x | | x | |

Work production is continuous throughout the duration of the cycle, but not at constant power, either because the pressure difference across the terminals of the hydraulic motor varies, or because a portion, which can vary over time, of this work is recovered by the auxiliary hydraulic pump $AHP_2$. This is not a problem if the work delivered to the outside is used directly for a receiving machine that does not have to be constant within the cycle, such as a water pump or a modified receiving Carnot machine. Of course, the average power over a cycle remains constant from one cycle to another, when a steady operating state is reached and if the temperatures $T_{hi}$ and $T_{lo}$ remain constant.

Moreover, the evaporator is isolated from the rest of the circuit during the γδ and λα phases, whereas the heat supplied by the hot source at $T_{hi}$ is a priori continuous. Under these conditions, during these isolation phases there will be a temperature rise and therefore a pressure rise in the evaporator followed by a sudden drop at times $t_\alpha$ and $t_\delta$ when the valve $SV_1$ or $SV_{1'}$ reopens.

In a preferred method of implementing the process of the invention, the fact that the transfer liquid $L_T$ is incompressible and the fact that the variations in level which occur simultaneously in the three chambers ABCD, CT and CT' are therefore not independent are taken into account. Moreover, these variations in the level of $L_T$ result from or involve concomitant variations in the volume of the fluid $G_T$. This is represented by the following equation between the densities of $G_T$ at various stages of the cycle:

$$\rho_e - \rho_a = \rho_c \quad \text{(Equation 1)}$$

$\rho_i$ being the density of $G_T$ at the thermodynamic state of the point "i", "i" being e, a, $d_{sv}$ and c respectively.

Figure 4:
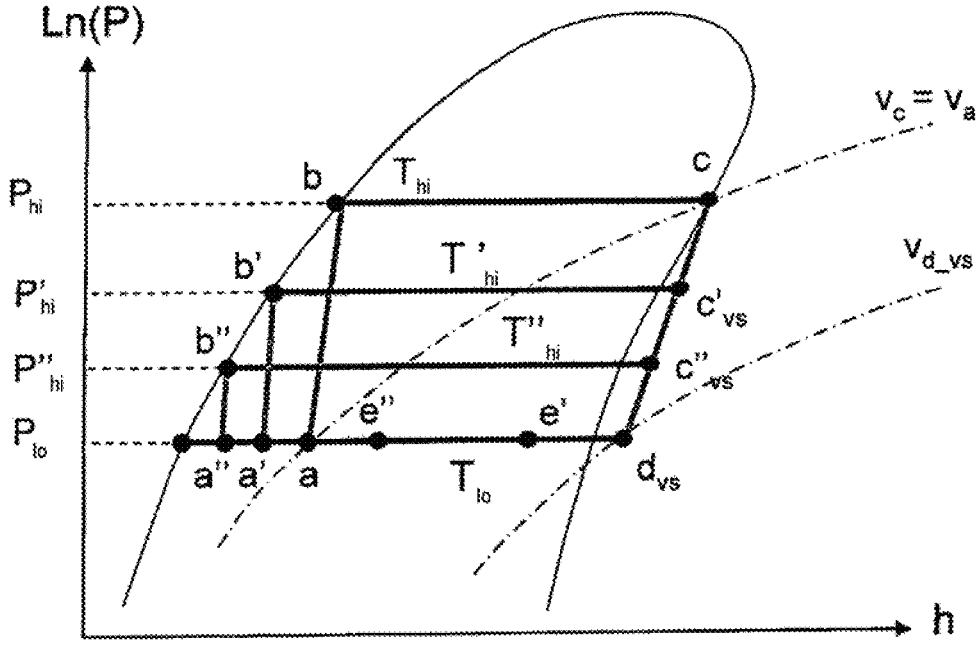
FIG. 4 shows, in a Mollier diagram, three modified driving Carnot cycles of the 2nd type that have the same temperature $T_{lo}$ of the working fluid during heat exchange with the cold sink and increasing temperatures $T''_{hi}$, $T'_{hi}$, and $T_{hi}$, of the working fluid during heat exchange with the hot source.

FIG. 4 shows the Mollier diagrams for three modified driving Carnot cycles of the 2nd type, namely the a"-b"-c"-$d_{sv}$-e"-a" cycle, the a'-b'-c'-$d_{sv}$-e'-a' cycle and the a-b-c-$d_{sv}$-a cycle. These three cycles have the same $G_T$ temperature $T_{lo}$ in the condenser and increasing $G_T$ temperatures in the evaporator, namely $T''_{hi}$, $T'_{hi}$ and $T_{hi}$; respectively. In this figure, the dot-dashed curves are curves at constant density.

When the temperatures of the condenser and the evaporator are very close (or even coincident), the point "e" in the Mollier diagram is close to the point "a" (or coincident therewith) as shown schematically in the a"-b"-c"-$d_{sv}$-e"-a" cycle. As the temperature difference between the heat sink and the heat source increases, the point "e" moves away from the point "a" and approaches the point "$d_{sv}$". The a'-b'-c'-$d_{sv}$-e'-a' cycle represents an intermediate case and the a-b-c-$d_{sv}$-a cycle represents the extreme case in which the points "e" and "$d_{sv}$" are coincident. As the efficiency of the modified driving Carnot cycle increases with the temperature difference between the heat sink and the heat source, the a-b-c-$d_{sv}$-a cycle is preferable provided that there is a heat source at the temperature $T_{hi}$ sufficient for a fixed sink temperature $T_{lo}$.

In this preferred case (in which $\rho_e = \rho_{dsv}$), equation 1 reduces to $\rho_c = \rho_a$ as shown in FIG. 4. Furthermore, the steps described in the general configuration of the operating process of the modified driving Carnot machine of the 2nd type are simplified since the $d_{sv}$ (or d)→e transformation no longer takes place.

Thus, the temperature difference ($T_{hi} - T_{lo}$) between the two isothermal transformations of the modified driving Carnot cycle cannot exceed a certain value $\Delta T_{max}$ which depends on one of the temperatures ($T_{hi}$ or $T_{lo}$ and on the chosen working fluid $G_T$. Now, the performance of the modified Carnot machine depends especially on this value $\Delta T_{max}$. To obtain the maximum performance with a given fluid $G_T$ and a given temperature $T_{hi}$ or $T_{lo}$, it is necessary to choose the other operating conditions such that the $\rho_a/\rho_c$ ratio is as close as possible to 1 (but always less than 1), or preferably such that $0.9 \leq \rho_a/\rho_c \leq 1$ and more particularly $0.95 \leq \rho_a/\rho_c \leq 1$.

The various thermodynamic transformations of this preferred method of implementation are given in Table 3 and the states of the actuators (solenoid valves and clutch of the pump $AHP_2$) are given in Table 4 in which x means that the corresponding solenoid valve is open or that the pump $AHP_2$ is engaged.

TABLE 3

| Step | Transformation | Location | $L_T$ level CT | CT' | ABCD |
|---|---|---|---|---|---|
| αβγ | a → b | ABCD | L | H→J | L→H |
| | b → c | Evap + CT' | | | |
| γδ | c → d or $d_{sv}$ | CT' | L→H | J→L | H→L |
| | d or $d_{sv}$ → a | CT + Cond + ABCD | | | |
| δελ | a → b | ABCD | H→J | L | L→H |
| | b → c | Evap + CT | | | |
| λα | c → d or $d_{sv}$ | CT | J→L | L→H | H→L |
| | d or $d_{sv}$ → a | CT' + Cond + ABCD | | | |

TABLE 4

| Step | $SV_1$ | $SV_{1'}$ | $SV_2$ | $SV_{2'}$ | $SV_3$ | $SV_4$ | $SV_{lo}$ | $SV_{hi}$ | $SV_{lo'}$ | $SV_{hi'}$ | $SV_r$ | $AHP_2$ |
|---|---|---|---|---|---|---|---|---|---|---|---|---|
| αβγ | | x | | | | x(to $t_\beta$) | | | | x | | x |
| γδ | | | x | | x | | x | | | x | x | |
| δελ | x | | | | | x (to $t_\epsilon$) | | x | | | | x |
| λα | | | | x | x | | | x | x | | x | |

The steps of the modified driving Carnot cycle of the 2nd type in the preferred configuration are explained in detail below if they differ from those described above for the general configuration.

Starting from an initial state in which, on the one hand, the working fluid $G_T$ is maintained in the evaporator Evap at high temperature and in the condenser Cond at low temperature by heat exchange with the hot source at $T_{hi}$ and the cold sink at $T_{lo}<T_{hi}$, respectively and, on the other hand, all the $G_T$ and transfer liquid $L_T$ communication circuits are closed, the working fluid $G_T$ is subjected to a succession of cycles comprising the following steps:

αβγ Phase (Between Times $t_\alpha$ and $t_\gamma$):

At time $t_\alpha$, the opening of the solenoid valves $SV_{1'}$ and $SV_{hi'}$ the engagement of $AHP_2$ cause the following effects:

the saturated $G_T$ vapor leaving the evaporator at $P_{hi}$ enters CT' and discharges the transfer liquid $L_T$ at an intermediate level (denoted by J). $L_T$ passes through the motor HM, being expanded therein, thereby producing work, a portion of which is recovered by the pump $AHP_2$; and after having been expanded by HM, the transfer liquid $L_T$ is taken in by the pump $AHP_2$ and delivered at a higher pressure to ABCD, which enables the liquid/vapor $G_T$ mixture contained in this chamber to be isentropically compressed.

In the Mollier diagram (FIG. 4), this step corresponds to the following simultaneous transformations:

a→b in the chamber ABCD;

b→c in the Evap-CT' assembly.

The pressurization of $G_T$ from $P_{lo}$ to $P_{hi}$ in ABCD must be carried out before it is introduced into the evaporator, which is always at the high pressure $P_{hi}$. It is therefore only at time $t_\beta$ that the solenoid valve $SV_4$ (which may be replaced by a nonreturn valve) between ABCD and Evap is opened.

From an energy standpoint, during this αβγ phase, heat $Q_{hi}$ has been consumed at the evaporator at $T'_{hi}$ and net work $W_{\alpha\beta\gamma}$ has also been delivered to the outside.

γδ Phase (Between Times $t_\gamma$ and $t_\delta$):

At time $t_\gamma$, that is to say when the level of $L_T$ has reached the predefined values (J in CT' and H in ABCD), the valves $SV_{1'}$ and $SV_4$ are closed, $SV_{hi'}$ is left open and the solenoid valves $SV_2$, $SV_3$, $SV_{lo}$ and $SV_r$ are opened. As a result:

the $G_T$ vapor contained in CT' continues to expand, but adiabatically or quasi-adiabatically, that is to say according to the c→d transformation (possibly followed by $d\rightarrow d_{sv}$) and discharges the transfer liquid $L_T$ through the motor HM into the cylinder CT. This transformation may be decomposed into a strictly adiabatic expansion (c→d) which ends up, depending on the fluid $G_T$, in the two-phase domain or in the superheated vapor, followed by a slight superheating ($d\rightarrow d_{sv}$) by the walls of CT' that are maintained at a sufficient temperature to allow this (between $T_{lo}$ and $T_{hi}$);

the chamber ABCD in communication with the condenser is brought back down to the low pressure and the transfer liquid $L_T$ that it contains in its lower portion flows under gravity into CT, which must therefore be preferably below ABCD. However, if the solenoid valve $SV_r$ is opened slightly before the solenoid valve $SV_3$ and if a small amount of $G_T$ remains in the saturated liquid state in the upper portion of ABCD, then the depressurization of $L_T$ during the step of communication with CT causes the remainder of said liquid $G_T$ initially at the high pressure $P_{hi}$ to be partially or completely vaporized. Under these conditions, the pressure upstream of $SV_r$ may be sufficient throughout the duration of the $L_T$ transfer to compensate for the liquid column height and the chamber ABCD is then not necessarily above the chambers CT and CT';

because of the rise in the level of $L_T$ (from L to H) in CT, the $G_T$ vapor contained in CT condenses in the condenser Cond (d or $d_{sv}$→a transformation); and the condensates do not accumulate in Cond since they flow under gravity into the chamber ABCD.

From an energy standpoint, during this γδ phase, heat $Q_{da}$ is released in the condenser at $T_{lo}$, a small amount of heat (taken from the hot source at $T_{hi}$) is possibly consumed in CT' in order to provide the superheating $d\rightarrow d_{sv}$ and work $W_{\gamma\delta}$ is also delivered to the outside.

As in the general case of the method of implementing the process of the invention in a modified driving Carnot machine of the 2nd type, the other half of the cycle is symmetric:

the δελ phase (between times $t_\delta$ and $t_\lambda$) is equivalent to the αβγ phase but with the transfer chambers CT and CT' reversed; and the λα phase (between times $t_\lambda$ and $t_\alpha$) is equivalent to the γδ phase but with the transfer chambers CT and CT' reversed.

More particularly:

at time $t_\delta$, all the circuits opened at time $t_\gamma$ are closed, the $G_T$ circuit between Evap and CT is opened (by $SV_1$), the $L_T$ circuit between CT and upstream of the hydraulic motor HM is opened (by $SV_{hi}$) and the auxiliary pump $AHP_2$ is actuated, so that:

the saturated $G_T$ vapor leaving Evap at the high pressure $P_{hi}$ enters CT and delivers $L_T$ at an intermediate level J;

$L_T$ passes through HM, expanding therein, and is then taken in by $AHP_2$ and discharged into ABCD;

at time $t_\epsilon$, the $G_T$ circuit between ABCD and Evap is opened (by $SV_4$) so that the working fluid $G_T$ is introduced into the evaporator in the liquid state;

at time $t_\lambda$, the $G_T$ circuit between Evap and CT on the one hand and between ABCD and Evap on the other is closed, the auxiliary pump $AHP_2$ is stopped, the $G_T$ circuit is opened between Cond and ABCD (by $SV_3$) on the one hand and between CT' and Cond (by $SV_{2'}$) on the other, and the $L_T$ circuit between CT' and ABCD is opened (by $SV_r$ and $SV_{lo'}$) so that:

the $G_T$ vapor contained in CT continues to expand, adiabatically, and discharges $L_T$ up to the low level in CT and then through HM into CT';

the chamber ABCD in communication with Cond is brought back down to the low pressure and $L_T$, which it contains in its lower portion, flows into CT'; and the $G_T$ vapor contained in CT' condenses in Cond.

After several cycles, the plant operates in a steady state in which the hot source continuously delivers heat at the temperature $T_{hi}$ to the evaporator Evap, heat is delivered continuously by the condenser Cond to the cold sink at the temperature $T_{lo}$, and work is delivered continuously by the machine.

In this preferred case of the modified driving Carnot cycle of the 2nd type, there is, for a given working fluid and for whatever temperature of the condenser $T_{lo}$, a maximum value of the temperature $T_{hi\text{-}max}$ of the evaporator such that the densities $\rho_c$ and $\rho_a$ are equal. However, if there is a heat source at a temperature $T_{hi}$ well above $T_{hi\text{-}max}$, it is possible a priori for the machine to have a higher efficiency, either by combining, in cascade, two modified driving Carnot machines in the plant of the invention, or by using, in the plant, a modified driving Carnot machine of the 1st type.

Figure 5:
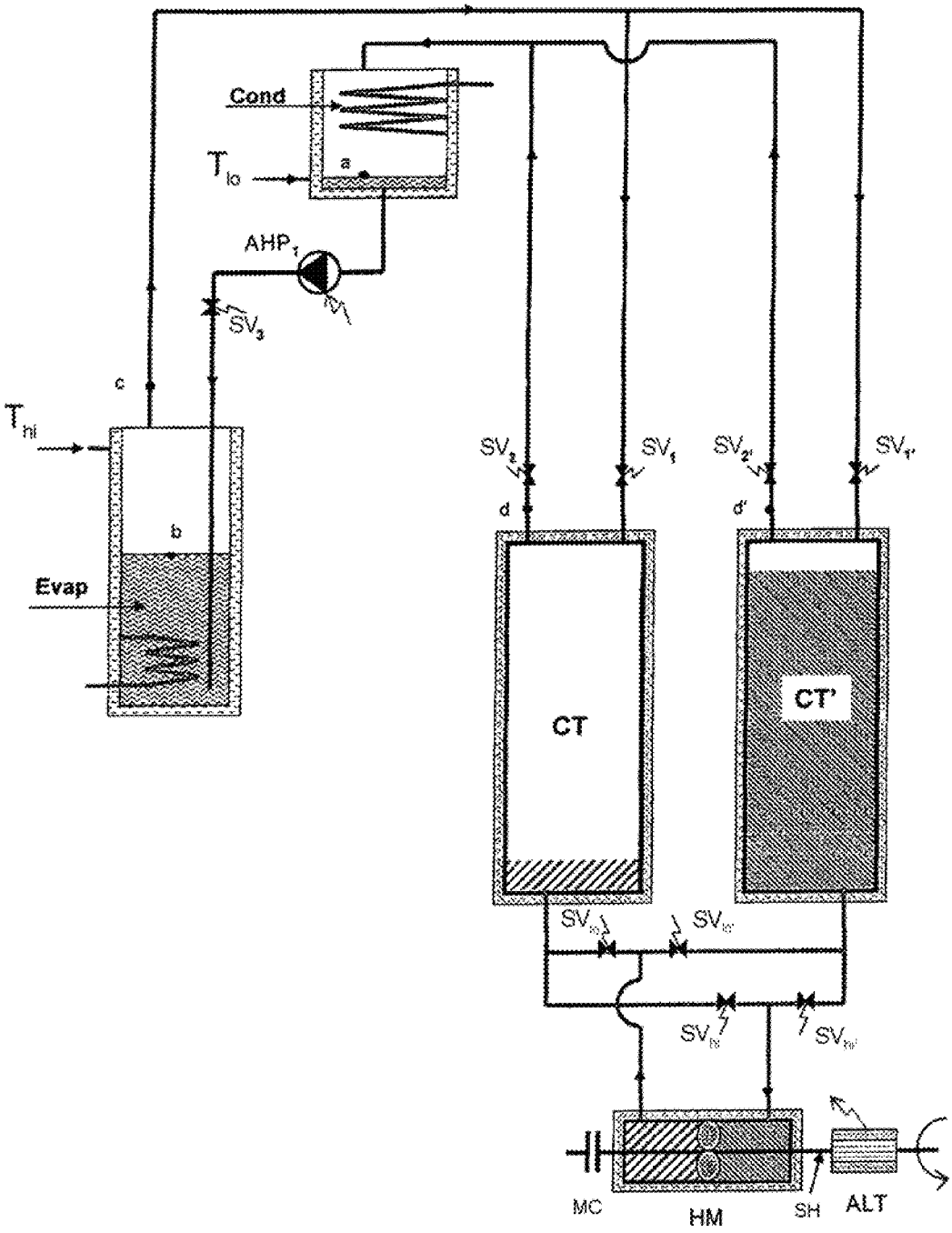
FIG. 5 is a schematic representation of a modified driving Carnot machine of the 1st type.

In a modified driving Carnot machine of the 1st type, the pressurization/expansion device placed between the condenser Cond and the evaporator Evap comprises an auxiliary hydraulic pump $AHP_1$ and a solenoid valve $SV_3$ in series. FIG. 5 is a schematic representation of the device. The elements identical to those of the driving machine of the 2nd type are denoted by the same references. The solenoid valve $SV_3$ may be replaced by a simple nonreturn valve, which itself may be integrated into the pump $AHP_1$. The working fluid $G_T$ in the saturated liquid state at the outlet of the condenser Cond is directly pressurized by the pump $AHP_1$ and introduced into the evaporator Evap.

In FIG. 5, the possibility of supplying heat at the temperature $T_i$ into the chambers CT and CT' has not been shown, but it remains possible as in FIG. 2.

The various steps of the cycle and the states of the actuators (solenoid valves and $AHP_1$ pump) are explained in detail below and given in Tables 5 and 6.

TABLE 5

| Step | Transformation | Location | $L_T$ level CT | $L_T$ level CT' |
|---|---|---|---|---|
| αβ | a → b | Between Cond and Evap | L→I | H→J |
| | b → $b_l$ → c | Evap + CT' | | |
| | $d_{sv}$ → e | CT + Cond | | |
| βγ | c → $d_{sv}$ | CT' | I→H | J→L |
| | e → a | CT + Cond | | |
| γδ | a → b | Between Cond and Evap | H→J | L→I |
| | b → $b_l$ → c | Evap + CT | | |
| | $d_{sv}$ → e | CT' + Cond | | |
| δα | c → $d_{sv}$ | CT | J→L | I→H |
| | e → a | CT' + Cond | | |

TABLE 6

| Step | Open solenoid valves or operating $AHP_1$ pump | | | | | | | | | |
|---|---|---|---|---|---|---|---|---|---|---|
| | $SV_1$ | $SV_{1'}$ | $SV_2$ | $SV_{2'}$ | $SV_3$ | $SV_{lo}$ | $SV_{hi}$ | $SV_{lo'}$ | $SV_{hi'}$ | $AHP_1$ |
| αβ | | x | x | | x | x | | | x | x |
| βγ | | | x | | x | x | | | x | x |
| γδ | x | | | X | x | | x | x | | x |
| δα | | | | X | x | | x | x | | x |

The steps of the modified driving Carnot cycle of the 1st type are described below for the points that differ from what has been described above for the modified driving Carnot cycle of the 2nd type in its general configuration. The first cycle is carried out from an initial state in which the working fluid $G_T$ is maintained in the evaporator Evap at high temperature and in the condenser Cond at low temperature by heat exchange with the hot source at $T_{hi}$ and the cold sink at $T_{lo}$, respectively, and all the communication circuits for the working fluid $G_T$ and for the transfer liquid $L_T$ are closed off. At time $t_0$, the auxiliary hydraulic pump $AHP_1$ is actuated and the $G_T$ circuit between Cond and Evap is opened (by $SV_3$) so that a portion of $G_T$, in the saturated or supercooled liquid state, is taken in by $AHP_1$ in the lower portion of the condenser Cond and discharged in the supercooled liquid state into Evap where it heats up, and then $G_T$ is subjected to a succession of modified Carnot cycles, each of which comprising the following steps:

αβ Phase (Between Times $t_\alpha$ and $t_\beta$):

At the time immediately preceding $t_\alpha$, the level of $L_T$ is low (denoted by L) in the cylinder CT and high (denoted by H) in the cylinder CT'. At the same instant, the saturation vapor pressure of $G_T$ has a low value $P_{lo}$ in CT and a high value $P_{hi}$ in Evap and CT'. It is this instant of the cycle which is shown schematically in FIG. 5.

At time $t_\alpha$, the opening of the solenoid valves $SV_{1'}$, $SV_2$, $SV_3$, $SV_{hi'}$ and $SV_{lo}$ and the operation of the $AHP_1$ cause the following effects:

- the saturated $G_T$ vapor leaving the evaporator at $P_{hi}$ enters CT' and discharges the transfer liquid $L_T$ at an intermediate level (denoted by J). $L_T$ passes through the motor HM, being expanded therein, thereby producing work. The work necessary for the $AHP_1$ is delivered by an independent electric motor (not shown). In a variant, the pump $AHP_1$ may be connected to the shaft of the hydraulic motor via the magnetic clutch MC so that, during this step, a portion of the work delivered by the hydraulic motor is recovered by the pump $AHP_1$;
- after having been expanded by HM, the transfer liquid $L_T$ is delivered into CT. In CT, $L_T$ passes from the low level to the intermediate level (denoted by I), discharges the $G_T$ vapor into the condenser, where it condenses. The working fluid $G_T$ in the saturated liquid state is taken in by the pump $AHP_1$ and delivered at a higher pressure into Evap, where it enters in the supercooled liquid state.

In the Mollier diagram (FIG. 6), this step corresponds to the following simultaneous transformations:

a→b between the condenser and the evaporator;

b→$b_1$→c in the Evap-CT' assembly;

$d_{sv}$→e in the CT-Cond assembly.

It is preferable for the auxiliary hydraulic pump $AHP_1$ not to be operating and for the solenoid valve $SV_3$ not to be open if there is no liquid $G_T$ upstream of this pump. A liquid level detector may be placed as safety element to stop the pump and close the solenoid valve if necessary. The evaporation of $G_T$ in Evap is continuously compensated for by supplies of liquid $G_T$ coming from the condenser so that the level of liquid $G_T$ in the evaporator is approximately constant.

Figure 6:
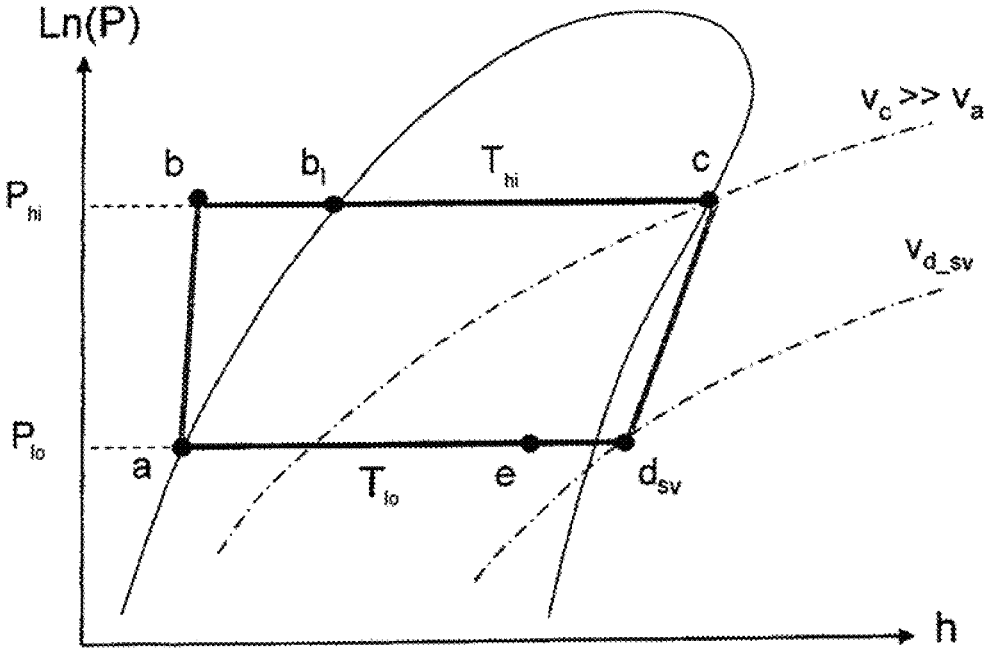
FIG. 6 shows, in a Mollier diagram, a modified driving Carnot cycle of the 1st type followed by a working fluid $G_T$. The pressure P is plotted on a logarithmic scale as a function of the enthalpy per unit mass h of the working fluid.

From an energy standpoint, during this αβ phase, heat $Q_{hi}$ has been consumed in the evaporator at $T_{hi}$, heat $Q_{de}$ has been released in the condenser at $T_{lo}$ ($T_{lo}<T_{hi}$) and net work $W_{\alpha\beta}$ has also been delivered to the outside, said work $W_{\alpha\beta}$ being the difference between the work delivered by the hydraulic motor HM and that consumed by the auxiliary hydraulic pump $AHP_1$.

βγ Phase (Between Times $t_\beta$ and $t_\gamma$):

At time $t_\beta$, that is to say when the level of $L_T$ has reached the predefined values (I in CT and J in CT'), the solenoid valve $SV_{1'}$ is closed, the valves $SV_2$, $SV_3$, $SV_{lo}$ and $SV_{hi'}$ are left open and the pump $AHP_1$ is operating (if liquid $G_T$ is present upstream). It follows that:

- the $G_T$ vapor contained in CT' continues to expand, but adiabatically ($c \rightarrow d_{sv}$ transformation in the Mollier diagram of FIG. 6) and again discharges the transfer liquid $L_T$ through the motor HM into the cylinder CT. As in the embodiment illustrated by FIG. 3, this transformation may be decomposed into a strictly adiabatic expansion ($c \rightarrow d$) which ends up, depending on the fluid $G_T$ used, in the two-phase domain or in the superheated vapor, followed by slight superheating ($d \rightarrow d_{sv}$) by the walls of CT' maintained at a sufficient temperature for allowing this (between $T_{lo}$ and $T_{hi}$);
- because of the rise in the level of $L_T$ (from I to H) in CT, the remainder of the $G_T$ vapor in CT condenses in Cond ($e \rightarrow a$ transformation); and as in the case of the previous step, the condensates are taken in by $AHP_1$ as they accumulate at the bottom of the condenser.

From an energy standpoint, during this βγ phase, heat $Q_{ea}$ is released in the condenser at $T_{lo}$, a small amount of heat (taken from the hot source at $T_{hi}$) is consumed in CT' for the $d \rightarrow d_{sv}$, superheating, and net work $W_{\beta\gamma}$ is also delivered to the outside.

The other half is symmetric: the evaporator and the condenser are the sites of the same successive transformations, whereas the roles of the chambers CT and CT' are reversed.

γδ Phase (Between Times $t_\gamma$ and $t_\delta$) and δα Phase (Between Times $t_\delta$ and $t_\alpha$):

These phases are equivalent to the αβ phase and the βγ phase respectively, but with the transfer chambers CT and CT' reversed.

More particularly:

- at time $t_\gamma$, the circuits opened at time $t_\beta$ are closed, except for that for transferring $G_T$ between Cond and Evap (via $SV_3$), the $G_T$ circuit is opened between Evap and CT (by $SV_1$) on the one hand and between CT' and Cond (by $SV_{2'}$) on the other, and the circuit for transferring $L_T$ from CT to CT' passing via the hydraulic motor HM is opened (by $SV_{hi}$ and $SV_{lo'}$), so that:
  - $G_T$ is heated and evaporates in Evap and the saturated $G_T$ vapor leaving Evap at the high pressure $P_{hi}$ enters CT and delivers $L_T$ at an intermediate level J;
  - $L_T$ passes through HM, being expanded therein, and then $L_T$ is delivered to CT' up to the intermediate level I;
  - the $G_T$ vapor contained in CT' and discharged by the liquid $L_T$ condenses in Cond; and
  - $G_T$ in the saturated or supercooled liquid state arrives in the lower portion of the condenser Cond, where it is progressively taken in by $AHP_1$ and then discharged in the supercooled liquid state into Evap;
- at time $t_\delta$, the $G_T$ circuit between Evap and CT is closed (i.e. closure of $SV_1$) so that:
  - the $G_T$ vapor contained in CT continues to expand, adiabatically, and discharges $L_T$ up to the low level in CT and then through HM into CT' where it reaches the high level;
  - the remainder of the $G_T$ vapor contained in CT' and discharged by the liquid $L_T$ condenses in Cond; and
  - $G_T$ in the saturated or supercooled liquid state arrives in the lower portion of the condenser Cond where it is progressively taken in by $AHP_1$ and finally discharged in the supercooled liquid state into Evap.

After several cycles, the plant operates in a steady state in which the hot source continuous delivers heat at high temperature $T_{hi}$ in the evaporator Evap, heat is continuously delivered by the condenser Cond into the cold sink at $T_{lo}$ and work is continuously delivered by the machine.

In this configuration (of the 1st type), equation (1) linking the densities of $G_T$ in the various steps of the cycle is still valid, i.e.:

$$\rho_e-\rho_a=\rho_{dsv}-\rho_c \quad \text{(equation 1)}$$

However, the density of $G_T$ leaving the condenser, i.e. in the saturated liquid state (point "a" in the Mollier diagram) is always much lower than that of $G_T$ leaving the evaporator, that is to say in the saturated or superheated vapor state (point "c" or "$c_{sv}$" in the Mollier diagram) irrespective of the temperature difference between $T_{hi}$ and $T_{lo}$. Thus, the following double inequality is still satisfied:

$$\rho_a<\rho_c<\rho_{dsv} \quad \text{(inequality 1)}$$

The point "e" is always between the points "a" and "$d_{sv}$" in the Mollier diagram and the temperatures $T_{lo}$ and $T_{hi}$ may be fixed completely independently without this affecting the operation of the modified driving Carnot machine of the 1st type.

The modified driving Carnot, machine of the 1st type is simpler in its operation and comprises fewer constituent elements. However, as in the case of the Rankine cycle, the $b \rightarrow b_1$ transformation generates appreciable irreversibilities, this having an unfavorable effect on the efficiency of the cycle. However, since the increase in the difference ($T_{hi}-T_{lo}$ has, conversely, a positive effect on this efficiency, it is possible, depending on the thermodynamic conditions and the fluid $G_T$ that are chosen, for the efficiency of the modified driving Carnot machine of the 1st type to be finally higher than that of the modified driving Carnot machine of the 2nd type, including in its preferred configuration.

When the process of the invention is a succession of modified receiving Carnot cycles, the heat source is at a temperature $T_{lo}$ below the temperature $T_{hi}$ of the heat sink. Each cycle is formed by a succession of steps during which there is a change in volume of the working fluid $G_T$. This variation in volume causes or is caused by a displacement of the liquid $L_T$. Thus during certain steps, the plant consumes work and restores work during other steps, but over the complete cycle there is a net consumption of work delivered by the environment via a hydraulic pump HP.

In a modified receiving Carnot machine of the 1st type, the adiabatic expansion step is isenthalpic rather than isentropic. This is because the work that can be recovered during the isentropic expansion is low in comparison with the work involved during the other steps of the cycle. The isenthalpic expansion requires only a simple irreversible adiabatic expansion device, the pressurization or expansion device may be a capillary tube or an expansion valve. In a modified receiving Carnot machine of the 2nd type, it is necessary for the pressurization and expansion device to be an adiabatic compression/expansion bottle ABCD and the associated transfer means. Thus, in this preferred configuration of the 1st type, the coefficient of performance or the coefficient of amplification of the modified receiving Carnot machine will be slightly reduced (while still being higher than the equivalent machines of the prior art) but with a significant simplification of the process and a lower cost.

When the process of the invention is a succession of modified receiving Carnot cycles, the heat source is at a temperature $T_{lo}$ below the temperature $T_{hi}$ of the heat sink. Each cycle is formed by a succession of steps during which there is a change in volume of the working fluid $G_T$. This variation in volume causes or is caused by a displacement of the liquid $L_T$. Thus during certain steps the plant consumes work and restores work during other steps, but over the complete cycle there is a net consumption of work delivered by the environment via a hydraulic pump HP.

Figure 7:
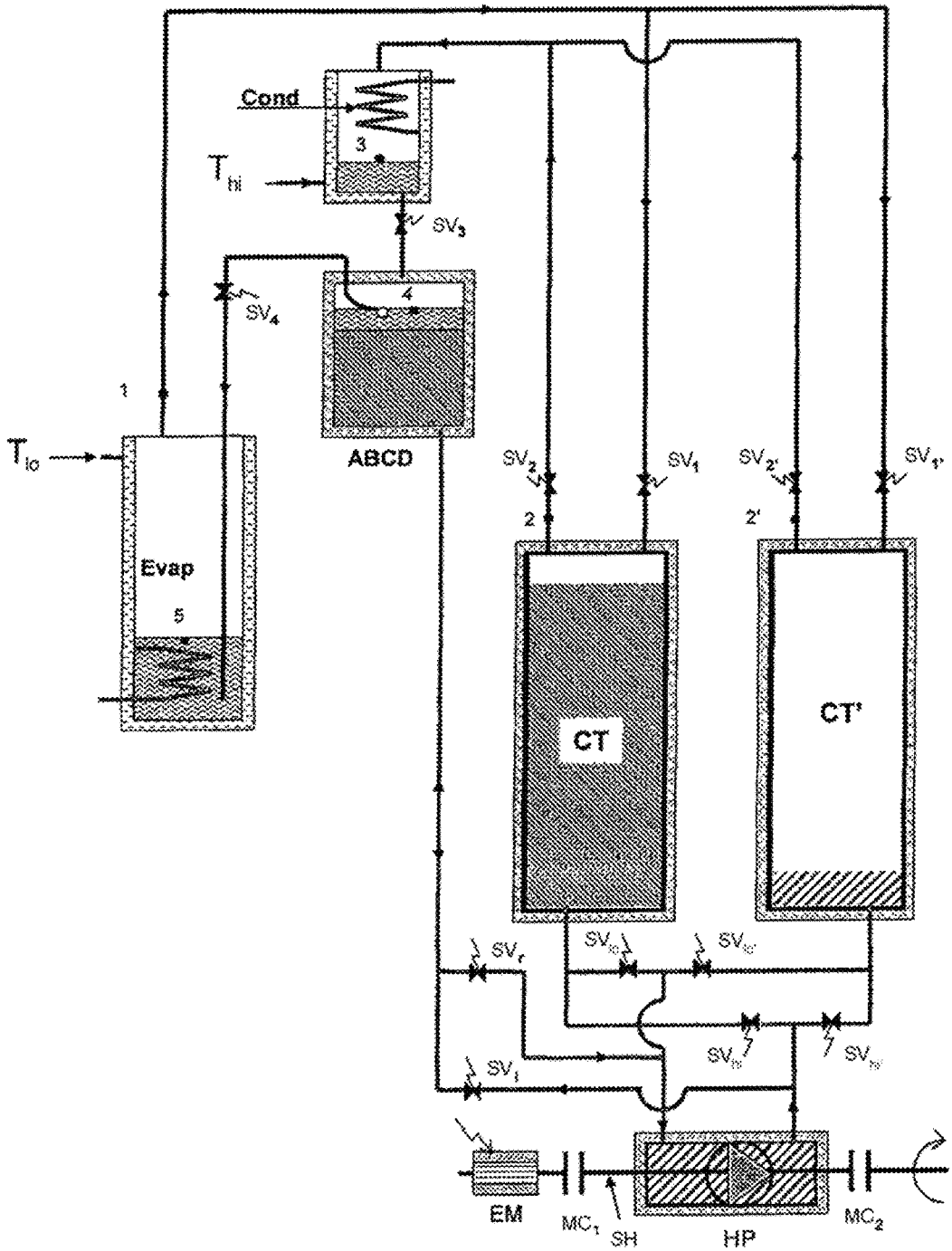
FIG. 7 shows a schematic view of a modified receiving Carnot machine of the 2nd type.

FIG. 7 shows a schematic view of a modified receiving Carnot machine of the 2nd type which comprises an evaporator Evap, a condenser Cond, an isentropic compression/expansion chamber ABCD, a hydraulic pump HP and two transfer chambers CT and CT'. These various elements are connected together by a first circuit containing exclusively the working fluid $G_T$ and a second circuit containing exclusively the transfer liquid $L_T$. Said circuits comprise various branches that can be closed off by means which may or may not be controlled. In the embodiment shown in FIG. 7, the controlled valves are two-way solenoid valves. However, other types of controlled valves may be used, especially pneumatic valves, slide valves or nonreturn valves. Certain pairs of two-way valves (i.e. having one inlet and one outlet) may be replaced with three-way valves (one inlet and two outlets, or two inlets and one outlet). Other possible valve combinations are within the competence of a person skilled in the art.

The evaporator Evap and the condenser Cond contain exclusively the fluid $G_T$ in general in the liquid/vapor mixture state. However, depending on the working fluid $G_T$ and the temperature $T_{hi}$ of the hot sink, said working fluid $G_T$ may be in the supercritical domain at $T_{hi}$ and under these conditions the condenser Cond contains $G_T$ only in the gaseous state.

Passing through the pump HP is exclusively liquid $L_T$. The elements ABCD, CT and CT' constitute the interfaces between the two ($G_T$ and $L_T$) circuits. They contain the hydraulic transfer fluid $L_T$ in the lower portion and/or the working fluid $G_T$ in the liquid, vapor or liquid-vapor mixture state in the upper portion. ABCD is connected to Cond and to Evap by circuits containing $G_T$ that can be closed off by the solenoid valves $SV_3$ and $SV_4$ respectively. Evap is connected to CT and CT' by circuits containing $G_T$ that can be closed off by the solenoid valves $SV_1$ and $SV_{1'}$ respectively. Cond is connected to CT and CT' by circuits containing $G_T$ that can be closed off by the solenoid valves $SV_2$ and $SV_{2'}$ respectively.

In general, the liquid passing through a hydraulic pump always flows in the same direction. It is this most common option which is shown in FIG. 7. This means that the low-pressure transfer liquid $L_T$ is always connected to the pump HP at the same inlet (on the left in FIG. 7) and that the high-pressure transfer liquid $L_T$ is always connected to the pump HP at the same outlet (on the right in FIG. 7). Since the chambers CT and CT' are alternately at high pressure and at low pressure, a set of solenoid valves serves to connect them to the appropriate inlet/output of the pump HP. Thus, the pump HP is connected on the inlet (or upstream) side to CT and CT' by a circuit containing $L_T$ at low pressure which can be closed off by the solenoid valves $SV_{lo}$ and $EV_{lo'}$ respectively, and on the outlet (or downstream) side to CT and CT' by a circuit containing $L_T$ at high pressure that can be closed off by the solenoid valves $SV_{hi}$ and $SV_{hi'}$ respectively. For example, if the high pressure is in the chamber CT' and the low pressure in CT, the solenoid valves $SV_{hi'}$ and $SV_{lo}$ are open and the solenoid valves $SV_{hi}$ and $SV_{lo'}$ are closed, the transfer liquid flows through HP from left to right. During the other half of the cycle, the high pressure is then in CT and the low pressure in CT', and the solenoid valves $SV_{hi'}$ and $SV_{lo}$ are closed and the solenoid valves $SV_{hi}$ and $SV_{lo'}$ are open, but the transfer liquid passes through the hydraulic pump in the same direction (from left to right).

ABCD is connected in its lower portion by two parallel branches of the circuit containing the transfer liquid $L_T$. The branch that can be closed off by the solenoid valve $SV_i$ is connected to the high-pressure $L_T$ circuit and the branch that can be closed off by the solenoid valve $SV_r$ is connected to the low-pressure circuit. When $L_T$ flows from ABCD into the transfer chamber CT or CT', it flows under gravity and it is therefore necessary for ABCD to be above the chambers CT and CT'.

The shaft of the hydraulic pump HP must be connected to one or more drive devices (i.e. delivering work) either directly or via a conventional coupling, such as a universal joint, a belt or a clutch (whether magnetic or mechanical). For example in FIG. 7, the shaft SH is connected to an electric motor EM via a magnetic clutch $MC_1$, whereas another magnetic clutch $MC_2$ serves to couple other motors, such as a hydraulic turbine, a gasoline or diesel engine, a gas-powered engine, or a modified driving Carnot machine. Finally, if necessary, a flywheel may also be mounted on this shaft to promote the concatenation of the receiving and driving steps of the cycle.

Figure 8:
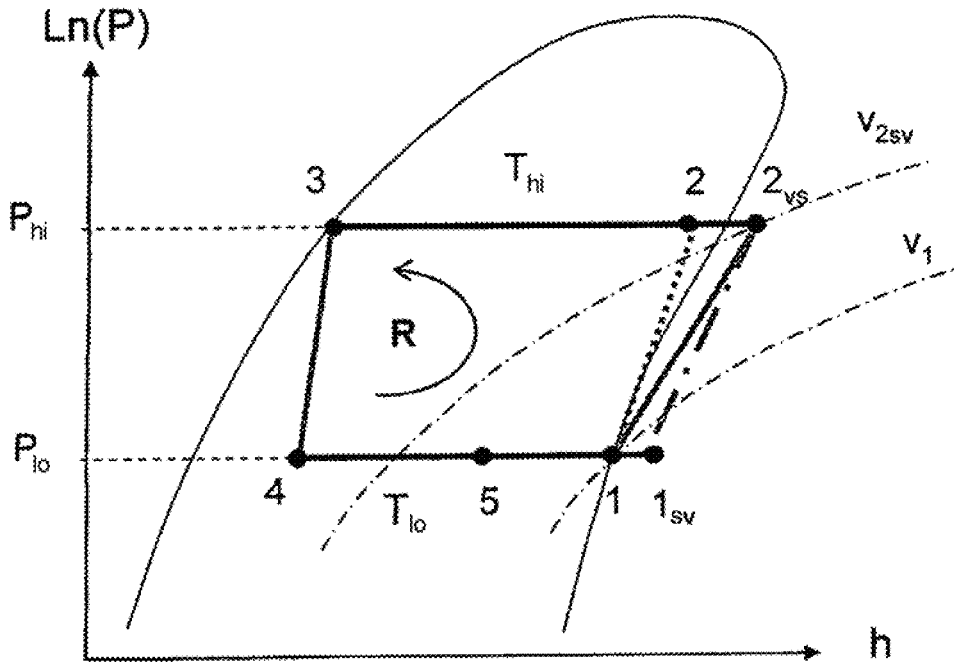
FIG. 8 shows, in a Mollier diagram, a modified receiving Carnot cycle of the 2nd type followed by a working fluid $G_T$. The pressure P is plotted on a logarithmic scale as a function of the enthalpy per unit mass h of the working fluid.

The modified receiving Carnot cycle followed by the driving fluid $G_T$ is described in the Mollier diagram shown in FIG. 8.

Depending on the fluid $G_T$ used, the step of isentropically compressing the saturated vapor at the outlet of the evaporator may result in a two-phase mixture or in superheated vapor. In FIG. 8, the first case (two-phase mixture, which is quite rare) is represented by the path between the points "1" and "2" shown by the dotted line and the second case (superheated vapor) is shown by the path between the points "1" and "$2_{sv}$" shown by the solid line. Moreover, irrespective of $G_T$, the vapor at the outlet of the evaporator may be slightly superheated in such a way that, after the isentropic compression, there is only superheated vapor or vapor at the saturation limit. This third case is shown in FIG. 8 by the path between the points "$1_{sv}$," and "$2_{sv}$" shown by the dot-dashed line. Any incursion at the start or end of the isentropic compression in the superheated vapor domain generates irreversibilities and therefore causes a slight reduction in the coefficient of performance or coefficient of amplification of the cycle. As in the case of the modified driving Carnot machine, it is possible to superheat $G_T$ at the inlet of the isentropic compression, but this provides only a slight advantage (it avoids any liquid $G_T$ being present in the chambers CT or CT') and only in the case in which said isentropic compression results in the two-phase domain. The technical solutions for producing this superheating are the same as in the case of the driving machine (electrical resistance element, heat exchange with the hot source at $T_{hi}$, etc.) and are not shown in FIG. 7.

The device for introducing the working fluid $G_T$ into the evaporator is designed so that $G_T$ is introduced in the liquid state into the evaporator, but after the saturated liquid (point 3 in the Mollier diagram of FIG. 8) has been expanded, and therefore occupying more volume and with an overhead above the remaining liquid (point 4 of the Mollier diagram in FIG. 8). One solution among other conceivable solutions consists in introducing a flexible suction tube with its sucking end fixed to a float in ABCD just beneath the float line. The chamber ABCD must be placed above the $G_T$ liquid level in the evaporator (as shown in FIG. 7) and above CT and CT' so that the discharge, either of liquid $G_T$ or of $L_T$, into one or other reservoir can take place by gravity.

The modified receiving Carnot cycle is formed by four successive phases starting at times $t_\alpha$, $t_\gamma$, $t_\delta$ and $t_\lambda$ respectively.

Only the 1-$2_{sv}$-3-4-5-1 cycle is described below since the variant with the "$1_{sv}$" point does not modify the principle.

Starting from an initial state in which all the communication circuits for the working fluid $G_T$ and for the transfer liquid $L_T$ are closed off, at $t_0$, the hydraulic pump HP is actuated and then $G_T$ is subjected to a succession of modified Carnot cycles, each of which comprising the following steps:

αβγ Phase:

At the instant immediately preceding $t_\alpha$, the level of $L_T$ is high (denoted by H) in ABCD and the cylinder CT, and is low (denoted by L) in the cylinder CT'. At the same instant, the saturation vapor pressure of $G_T$ has a high value $P_{hi}$ in ABCD, Cond and CT and has a low value $P_{lo}$ in Evap and CT'. It is this instant of the cycle which is shown schematically in the configuration of FIG. 7.

At time $t_\alpha$, the solenoid valves $SV_r$, $SV_{lo}$ and $SV_{hi'}$ are opened. The isentropic expansion of $G_T$ to the liquid/vapor mixture state (but with an almost zero vapor content by weight) in ABCD discharges $L_T$ through HP. At the same time, the very small amount of saturated vapor and the transfer liquid $L_T$ that are contained in CT follow the same pressure variation, which, owing to the small amount of vapor, is not accompanied by a significant variation in the level of $L_T$ in CT. The transfer liquid $L_T$ downstream of HP isentropically compresses the $G_T$ vapor contained in CT'. The pressures upstream and downstream of the pump HP are balanced at time $t_\beta$. Between $t_\alpha$ and $t_\beta$ there is theoretically no net consumption of work delivered by the pump HP. The time interval $t_\beta$-$t_\alpha$ is short, since during this step there is no heat transfer.

At time $t_\beta$, the solenoid valves $SV_1$ and $SV_4$ are opened. The consequences are the following:

after $SV_1$ has been opened, the saturated $G_T$ vapor leaving the evaporator at $P_{hi}$ enters CT and delivers the transfer liquid $L_T$ at an intermediate level (denoted by J). This liquid is taken in and pressurized by the pump HP, which consumes net work delivered by the outside. On leaving the pump, $L_T$ is delivered into the cylinder CT' (up to the level I), thereby enabling the isentropic compression of $G_T$ up the pressure $P_{hi}$ to be completed; and after $SV_4$ has been opened, the working fluid $G_T$ in the saturated liquid state and at low pressure $P_{lo}$ flows under gravity into the evaporator Evap, which more than compensates, in terms of mass, for the gaseous $G_T$ outlet into CT.

During this αβγ phase, the following transformations were carried out:

3→4 transformation in ABCD;

4→5 transformation in the Evap-CT assembly; and

1→$2_{sv}$ transformation in CT'. The compression is isentropic and it is assumed that, for the fluid $G_T$ used, this ends up in the superheated vapor domain.

From an energy standpoint, during this αβγ phase, heat $Q_{45}$ has been pumped into the evaporator at $T_{lo}$ and work $W_{\alpha\beta\gamma}$ has also been consumed by the pump HP. This work has been delivered by the outside with a power increasing from $t_\beta$ since the pressure upstream of the pump remains virtually constant (=$P_{lo}$) after this instant, whereas the downstream pressure increases up to $P_{hi}$.

γδ Phase:

At time $t_\gamma$, i.e. when the level of $L_T$ has reached the predefined values (L in ABCD, J in CT and I in CT'), $SV_1$, $SV_{lo}$ and $SV_{hi'}$ are left open and the solenoid valves $SV_{2'}$, $SV_3$ and $SV_i$ are opened simultaneously. As a result, the $G_T$ vapor continues to be produced in the evaporator and to be expanded in CT (5→1 transformation), thereby again discharging the transfer liquid taken in by the pump into the cylinder CT', which is this time connected to the condenser. The $G_T$ vapor contained in CT' is desuperheated (partly in CT') and completely condenses in the condenser ($2_{sv}$→3 transformation) in which the vapor does not accumulate since it is discharged under gravity into ABCD. In parallel, a portion of the transfer liquid $L_T$ output by the pump is discharged into ABCD, in order to reestablish the high $L_T$ level therein.

From an energy standpoint, during this αβ phase, heat $Q_{51}$ is pumped into the evaporator at $T_{lo}$, heat $Q_{23}$ is released in the condenser at $T_{hi}$ (with $T_{hi}$>$T_{lo}$), which requires work $W_{\gamma\delta}$ delivered by the outside. This work is at almost constant power since the pressures upstream and downstream of the pump are also practically constant (with nonlimiting heat exchangers at the condenser and the evaporator).

At time $t_\delta$, one half of the cycle is complete. The other half is symmetric: the evaporator, the condenser and the chamber ABCD are the sites for the same successive transformations, but the roles of the chambers CT and CT' are reversed.

δελ Phase (Between Times $t_\delta$ and $t_\lambda$) and λα Phase (Between Times $t_\lambda$ and $t_\alpha$):

These phases are equivalent to the αβγ phase and to the γδ phase respectively, but with the transfer chambers CT and CT' reversed.

More particularly:

at time $t_\delta$, all the circuits opened at time $t_\gamma$ are closed, the $L_T$ circuits for transferring $L_T$ are opened (by $SV_r$) on the one hand from the chamber ABCD to the upstream end of the hydraulic pump HP and, on the other hand, from CT' to CT passing via the hydraulic pump HP (by $SV_{lo'}$ and $SV_{hi}$) so that:

$G_T$ in the liquid/vapor equilibrium state in ABCD and in CT' is expanded from the high pressure $P_{hi}$ to the low pressure $P_{lo}$ and delivers $L_T$ through HP into CT;

the $G_T$ vapor contained in CT is adiabatically compressed;

at time $t_\epsilon$, the $G_T$ circuit is opened between Evap and CT' (by $SV_{1'}$) on the one hand and between ABCD and Evap (by $SV_4$) on the other, so that:

$L_T$ is taken in by the pump HP, which pressurizes it and discharges it into CT;

the $L_T$ levels in ABCD, CT and CT' pass from high to low, from low to an intermediate level I, and from high to an intermediate level J, respectively;

because the volume occupied by the $G_T$ vapor in CT' increases, $G_T$ evaporates in Evap and the saturated $G_T$ vapor leaving Evap at the low pressure $P_{lo}$ enters CT';

the $G_T$ vapor contained in CT continues to be adiabatically compressed up to the high pressure $P_{hi}$;

$G_T$ in the saturated liquid state at the low pressure $P_{lo}$ flows under gravity from ABCD into Evap;

at time $t_\lambda$, the $G_T$ circuit between ABCD and Evap is closed (by $SV_4$), the $L_T$ circuit between ABCD and the upstream side of the pump HP is closed (by $SV_r$), the $G_T$ circuit is opened between CT and Cond (by $SV_2$) on the one hand and between Cond and ABCD (by $SV_3$) on the other, and the $L_T$ circuit between the downstream side of the pump HP and ABCD is opened (by $SV_i$) so that:

$L_T$ is again taken in by the pump HP, which pressurizes it and delivers it into CT;

the $L_T$ levels in ABCD, CT and CT' pass from low to high, from the intermediate level I to high and from the intermediate level J to low, respectively;

because the volume occupied by the $G_T$ vapor in CT' continues to increase, $G_T$ evaporates in Evap and the saturated $G_T$ vapor leaving Evap at the low pressure $P_{lo}$ enters CT';

the $G_T$ vapor contained in CT at high pressure $P_{hi}$ is discharged by $L_T$ and condenses in Cond; and $G_T$ in the saturated liquid state flows under gravity from Cond into ABCD.

After several cycles, the plant operates in a steady state.

For refrigeration, in the initial state $G_T$ is maintained in the condenser Cond at high temperature by heat exchange with the hot sink at $T_{hi}$ and in the evaporator Evap at a temperature equal to or below $T_{hi}$ by heat exchange with a medium external to the machine, said medium having initially a temperature $T_{hi}$. In the steady state, net work is consumed by the hydraulic pump HP, the condenser Cond continuously removes heat to the hot sink at high temperature $T_{hi}$ and heat is continuously consumed by the evaporator Evap, with extraction of heat from the external medium in contact with said evaporator Evap, the temperature $T_{lo}$ of said external medium being strictly below $T_{hi}$.

For heat production, in the initial state $G_T$ is maintained in the evaporator Evap at low temperature by heat exchange with the cold source at $T_{lo}$ and $G_T$ is maintained in the condenser Cond at a temperature $T_{hi} \geq T_{lo}$ by heat exchange with a medium external to the machine, said medium having initially a temperature $\geq T_{hi}$. In the steady state, net work is consumed by the hydraulic pump HP, the cold source at $T_{lo}$ continuously supplies heat to the evaporator Evap, the condenser Cond continuously delivers heat to the hot sink, the plant producing heat to the external medium in contact with said condenser Cond, the external medium having a temperature $T_{hi} > T_{lo}$.

After the $\lambda\alpha$ phase, the modified receiving Carnot machine of the 2nd type is in the $\alpha$ state of the cycle. The various thermodynamic transformations undergone by the fluid $G_T$ and the levels of the transfer liquid $L_T$ are given in Table 7. The states of the solenoid valves are given in Table 8, in which "x" means that the corresponding valve is open.

TABLE 7

| Step | Transformation | Location | $L_T$ Level CT | CT' | ABCD |
|---|---|---|---|---|---|
| $\alpha\beta\gamma$ | 3 → 4 | ABCD | H → J | L → I | H → L |
| | 4 → 5 | Evap + CT | | | |
| | 1 → $2_{sv}$ | CT' | | | |
| $\gamma\delta$ | 5 → 1 | Evap + CT | J → L | I → H | L → H |
| | $2_{sv}$ → 3 | CT' + Cond + ABCD | | | |
| $\delta\epsilon\lambda$ | 3 → 4 | ABCD | L → I | H → J | H → L |
| | 4 → 5 | Evap + CT' | | | |
| | 1 → $2_{sv}$ | CT | | | |
| $\lambda\alpha$ | 5 → 1 | Evap + CT' | I → H | J → L | L → H |
| | $2_{sv}$ → 3 | CT + Cond + ABCD | | | |

TABLE 8

| Step | Open solenoid valves $SV_1$ | $SV_{1'}$ | $SV_2$ | $SV_{2'}$ | $SV_3$ | $SV_4$ | $SV_{lo}$ | $SV_{hi}$ | $SV_{lo'}$ | $SV_{hi'}$ | $SV_r$ | $SV_i$ |
|---|---|---|---|---|---|---|---|---|---|---|---|---|
| $\alpha\beta\gamma$ | x (to $t_\beta$) | | | | | x (to $t_\beta$) | x | | | x | x | |
| $\gamma\delta$ | x | | | x | x | | x | | | x | | x |
| $\delta\epsilon\lambda$ | | x (to $t_\epsilon$) | | | | x (to $t_\epsilon$) | | x | x | | x | |
| $\lambda\alpha$ | | x | x | | x | | | x | x | | | x |

Work consumption is continuous over the duration of the cycle (excluding between the times $t_\alpha$ and $t_\beta$ on the one hand and $t_\delta$ and $t_\epsilon$ on the other), but not always at constant power insofar as the pressure difference at the terminals of the hydraulic pump may vary. Of course, the average power over a cycle remains constant from one cycle to another, when a steady operating state is reached and if the temperatures $T_{hi}$ and $T_{lo}$ remain constant. Moreover, the condenser is isolated from the rest of the circuit during the $\alpha\beta\gamma$ and $\delta\epsilon\lambda$ phases, whereas the removal of heat in the hot sink at $T_{hi}$ is a priori continuous. Under these conditions, during these isolation phases there will be a temperature drop and therefore a pressure drop in the condenser and then a sudden rise at times $t_\gamma$ and $t_\lambda$ upon the valve $SV_2$ or the valve $SV_{2'}$ reopening.

Since the transfer liquid $L_T$ is incompressible, the variations in level that occur simultaneously in the three chambers ABCD, CT and CT' are not independent. Moreover, these variations in the level of $L_T$ result from or involve concomitant variations in the volume of the fluid $G_T$. This is expressed by the following equation between the densities of $G_T$ at various stages of the cycle represented in FIG. 8:

$$\rho_5 - \rho_3 = \rho_1 - \rho_{2sv} \quad \text{(equation 2)}$$

$\rho_i$ being the density of $G_T$ in the thermodynamic state of the point "i", "i" being the points 5, 3, 1 and respectively. Examples of curves at constant density are shown as dot-dash lines in FIG. 8.

Unlike the modified driving Carnot cycle of the 2nd type, here there is no limit to the temperature difference between the cold source at $T_{lo}$ and the hot sink at $T_{hi}$. Since the density at the point "3" is always the lowest of the cycle, the following double inequality again applies, irrespective of $T_{hi}$ and $T_{lo}$:

$$\rho_4 < \rho_5 < \rho_1 \quad \text{(inequality 2)}$$

Figure 10:
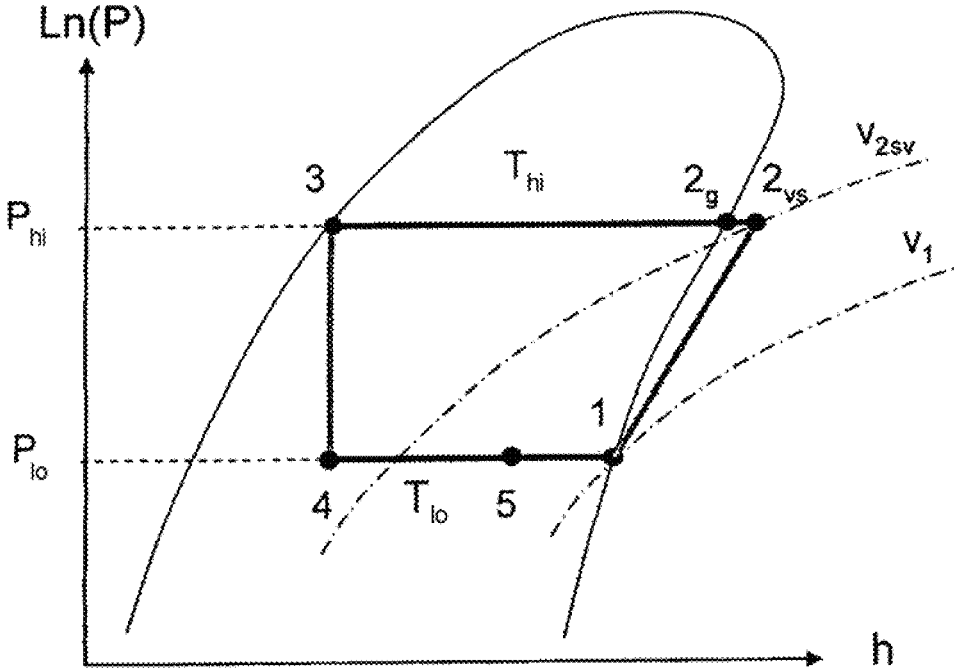
FIG. 10 shows, in a Mollier diagram, a modified receiving Carnot cycle of the 1st type followed by a working fluid $G_T$. The pressure P is plotted on a logarithmic scale as a function of the enthalpy per unit mass h of the working fluid.
Figure 9:
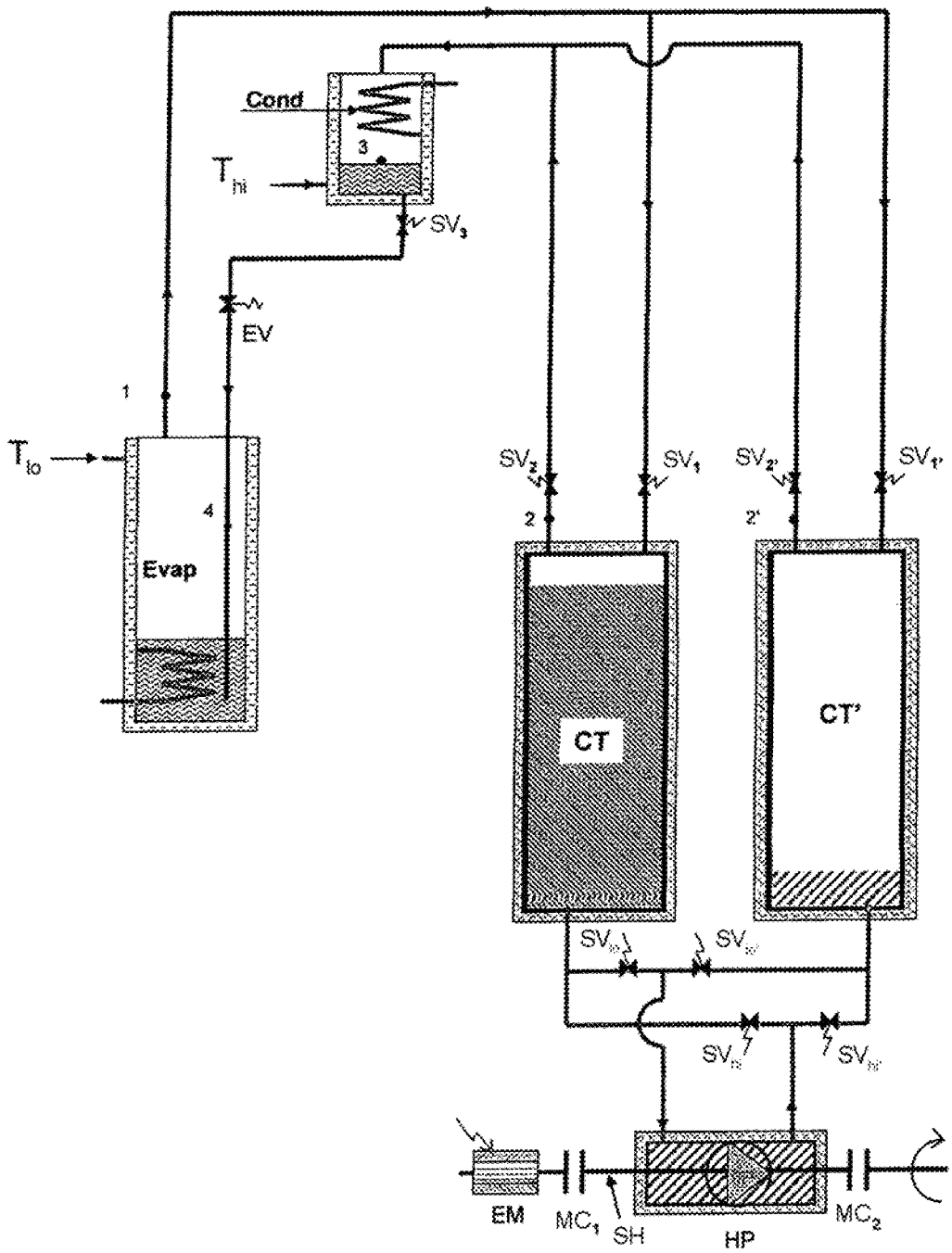
FIG. 9 shows a schematic view of a modified receiving Carnot machine of the 1st type.

In a modified receiving Carnot machine of the 1st type, the pressurization/expansion device is inserted in series between the condenser Cond and the evaporator Evap; it comprises a simple expansion device, such as for example an expansion valve EV or a capillary tube, and possibly in series a solenoid valve $SV_3$. Such a device is shown in FIG. 9, in which the legends have the same meanings as in the other figures, and the combination of EV and $SV_3$ constitutes the expansion device. The working fluid $G_T$ in the saturated liquid state leaving the condenser Cond is immediately expanded and introduced into the evaporator Evap. An example of such a modified receiving Carnot cycle of the 1st type is shown schematically by the 1-$2_{sv}$-$2_g$-3-4-5-1 cycle in the Mollier diagram of FIG. 10.

The various steps of the cycle and the states of the solenoid valves are explained in detail below and given in Tables 9 and 10. The solenoid valve $SV_3$ is not essential since, when the machine is in operation, it is always open. Its only benefit is to be able to isolate the condenser from the evaporator on stopping the machine.

TABLE 9

| Step | Transformation | Location | $L_T$ Level CT | CT' |
|---|---|---|---|---|
| $\alpha\beta$ | 3 → 4 | Between Cond and Evap | H→J | L→I |
| | 4 → 5 | Evap + CT | | |
| | 1 → $2_{sv}$ | CTe' | | |

TABLE 9-continued

| Step | Transformation | Location | $L_T$ Level CT | $L_T$ Level CT' |
|---|---|---|---|---|
| βγ | 5 → 1<br>$2_{sv} \rightarrow 2_g \rightarrow 3$ | Evap + CT<br>CT' + Cond | J→L | I→H |
| γδ | 3 → 4 | Between Cond and Evap | L→I | H→J |
| | 4 → 5<br>1 → $2_{sv}$ | Evap + CT'<br>CT | | |
| δα | 5 → 1<br>$2_{sv} \rightarrow 2_g \rightarrow 3$ | Evap + CT'<br>CT + Cond | I→H | J→L |

TABLE 10

| Step | Open solenoid valves $SV_1$ | $SV_{1'}$ | $SV_2$ | $SV_{2'}$ | $SV_3$ | $SV_{lo}$ | $SV_{hi}$ | $SV_{lo'}$ | $SV_{hi'}$ |
|---|---|---|---|---|---|---|---|---|---|
| αβ | x | | | | x | x | | | x |
| βγ | x | | | x | x | x | | | x |
| γδ | | x | | | x | | x | x | |
| δα | | x | x | | x | | x | x | |

The steps of the modified receiving Carnot cycle Of the 1st type are explained in detail below when they differ from those described above in the case of the modified receiving Carnot cycle of the 2nd type.

Starting from an initial state in which all the communication circuits for the working fluid $G_T$ and for the transfer liquid $L_T$ are closed off, at time $t_0$ the hydraulic pump HP is actuated and the $G_T$ circuit between Cond and Evap is opened (by $SV_3$) and $G_T$ is subjected to a succession of modified Carnot cycles, each of which comprising the following steps:

αβ Phase (Between Times $t_\alpha$ and $t_\beta$):

At the instant immediately preceding $t_\alpha$, the level of $L_T$ is high (denoted by H) in the cylinder CT and low (denoted by L) in the cylinder CT'. At the same instant, the saturation vapor pressure of $G_T$ has a high value $P_{hi}$ in Cond and CT and a low value $P_{lo}$ in Evap and CT'. It is this instant of the cycle which is shown schematically in FIG. 9.

At time $t_\alpha$, the opening of the solenoid valves $SV_1$, $SV_3$. $SV_{lo}$ and $SV_{hi'}$, has the following consequences:

- the saturated vapor of $G_T$ leaving the evaporator at $P_{lo}$ enters CT and delivers the transfer liquid $L_T$ to an intermediate level (denoted by J). $L_T$ is taken in by the pump HP which pressurizes it, thereby consuming work;
- after having been pressurized by HP, the transfer liquid $L_T$ is delivered in CT'. In CT', $L_T$ passes from the low level to the intermediate level (denoted by I) and isentropically compresses the $G_T$ vapor contained in this chamber; and
- following the opening of $SV_3$, the working fluid $G_T$ in the saturated liquid state and at high pressure $P_{hi}$ is expanded by the valve EV and then introduced in the two-phase mixture state into the evaporator Evap, thereby compensating in terms of mass for the discharge of gaseous $G_T$ into CT.

In the Mollier diagram (shown in FIG. 10), this step corresponds to the following simultaneous transformations:

- the 3→4 transformation between Cond and Evap;
- the 4→5 transformation in the Evap-CT assembly; and
- the 1→$2_{sv}$ transformation in CT'.

As previously, the working fluid $G_T$ used is supposed to end up, after this isentropic transformation, in the superheated vapor domain.

From an energy standpoint, during this αβ phase, heat $Q_{45}$ has been pumped into the evaporator at $T_{lo}$ and work $W_{\alpha\beta}$ has also been consumed by the pump HP. This work has been delivered by the outside at increasing power since the pressure upstream of the pump remains practically constant (=$P_{lo}$), whereas the downstream pressure increases up to $P_{hi}$.

βγ Phase (Between Times $t_\beta$ and tγ):

At time $t_\beta$, that is to say when the level of $L_T$ has reached the predefined values (J in CT and I in CT'), $SV_1$, $SV_3$, $SV_{lo}$ and $SV_{hi'}$ are left open and the solenoid valve $SV_2$ is opened. As a result, the $G_T$ vapor continues to be produced in the evaporator and to expand in CT (5→1 transformation), thereby again delivering the transfer liquid taken up by the Pump into the cylinder CT', which this time is connected to the condenser. The $G_T$ vapor contained in CT' is desuperheated (i.e. the $2_{sv} \rightarrow 2_g$ transformation partly in CT') and condenses completely in the condenser ($2_{sv} \rightarrow 2_g \rightarrow 3$ transformation). The fluid $G_T$ in the saturated liquid state is expanded by EV and introduced into the evaporator.

From an energy standpoint, during this βγ phase, heat $Q_{51}$ is pumped into the evaporator at $T_{lo}$, heat $Q_{23}$ is released into the condenser at $T_{hi}$ (where $T_{hi} > T_{lo}$), thereby requiring work $W_{\gamma\delta}$ delivered by the outside. This work is at a virtually constant power since the pressures upstream and downstream of the pump are also practically constant (with nonlimiting heat exchangers at the condenser and the evaporator).

At time $t_\gamma$, one half of the cycle has been completed. The other half is symmetric: the evaporator and the condenser are the sites for the same successive transformations, while the roles of the chambers CT and CT' are reversed.

γδ Phase (Between Times $t_\gamma$ and $t_\delta$) and δα Phase (Between Times $t_\delta$ and $t_\alpha$):

These phases are equivalent to the αβ phase and to the βγ phase respectively, but with the transfer chambers CT and CT' reversed.

More particularly:

- at time $t_\gamma$, all the circuits open at time $t_\beta$ are closed, except for the $G_T$ circuit between Cond and Evap, the $L_T$ circuit enabling $L_T$ to be transferred from CT' to CT passing via the hydraulic pump HP is opened (by $SV_{lo}$ and $SV_{hi}$) and the $G_T$ circuit between Evap and CT' is opened (by $SV_{1'}$) so that:
  - $L_T$ is taken in by the pump HP, which pressurizes it and delivers it into CT;
  - the level of $L_T$ in CT passes from the low level to an intermediate level I, and in CT' from the high level to an intermediate level J;
  - since the volume occupied by the $G_T$ vapor in CT' increases, the working fluid $G_T$ evaporates in Evap and the saturated vapor of $G_T$ leaving Evap at the low pressure $P_{lo}$ enters CT';
  - the $G_T$ vapor contained in CT is adiabatically compressed up to the high pressure $P_{hi}$; and
  - $G_T$ in the saturated or supercooled liquid state in Cond and at the high pressure $P_{hi}$ is expanded isenthalpically and introduced in the liquid/vapor two-phase mixture state and at the low pressure $P_{lo}$ into the evaporator Evap;
- at time $t_\delta$, the $G_T$ circuit between CT and Cond is opened (by $SV_2$) so that:
  - $L_T$ is again taken in by the pump HP, which pressurizes it and delivers it into CT;
  - the level of $L_T$ in CT passes from the intermediate level I to the high level and in CT' from the intermediate level J to the low level;

because the volume occupied by the $G_T$ vapor in CT' continues to increase, $G_T$ evaporates in Evap and the saturated $G_T$ vapor leaving Evap at the low pressure $P_{lo}$ enters CT'; and the $G_T$ vapor contained in CT, at the high pressure $P_{hi}$, is delivered by $L_T$ and condenses in Cond.

After several cycles, the plant operates in a steady state.

As regards refrigeration: in the initial state, $G_T$ is maintained in the condenser Cond at high temperature by heat exchange with the hot sink at $T_{hi}$ and in the evaporator Evap at a temperature equal to or below $T_{hi}$ by heat exchange with a medium external to the machine, said medium having initially a temperature equal to or below $T_{hi}$; and in the steady state, net work is consumed by the hydraulic pump HP, the condenser Cond continuously removes heat to the hot sink at high temperature $T_{hi}$ and heat is continuously consumed by the evaporator Evap, that is to say heat is extracted from the external medium in contact with said evaporator Evap, the temperature $T_{lo}$ of said external medium being strictly below $T_{hi}$.

As regards heat production: in the initial state, $G_T$ is maintained in the evaporator Evap at low temperature by heat exchange with the cold source at $T_{lo}$, and in the condenser Cond at a temperature equal to or above $T_{hi}$ by heat exchange with a medium external to the plant at a temperature equal to or above $T_{hi}$; and, in the steady state, net work is consumed by the hydraulic pump HP, the cold source at $T_{lo}$ continuously supplies heat to Evap, and Cond continuously removes heat to the hot sink, that is to say there is heat production to the external medium in contact with Cond, the temperature $T_{hi}$ of said external medium being strictly above $T_{lo}$.

In this configuration (called the receiving configuration of the 1st type), equation (2) and inequality (2) linking the densities of $G_T$ in the various steps of the cycle are still valid.

The modified receiving Carnot machine of the 1st type is simpler in its operation and comprises fewer constituent elements. However, as in the case of a conventional mechanical vapor compression cycle, the $3 \rightarrow 4$ and $2_{sv} \rightarrow 2_g$ transformations generate a few irreversibilities, this having an unfavorable effect on the coefficient of performance or coefficient of amplification of the cycle. However, since this degradation is moderate, the configuration of the 1st type is preferred for the modified receiving Carnot machine. This is because, although the modified receiving Carnot machine of the 1st type is similar to conventional mechanical vapor compression machines, it still retains two key advantages:

the adiabatic compression step ($1 \rightarrow 2_{sv}$) has a higher isentropic compression efficiency, it is less noisy and more reliable; and the same machine, by slight modifications, may operate in driving mode, something which is not possible with the machines of the prior art.

The choice of one or other type of receiving machine will be made according to the means available, especially according to the temperature of the heat source and heat sink, the working fluid $G_T$ and the intended result.

The same modified Carnot machine may provide, alternately, depending on the user's choice, either the driving function or the receiving function. In such a case, said modified Carnot machine is termed a "multipurpose" machine. This possibility means that the machine possesses the constituent elements necessary for satisfying each of the two (driving or receiving) operating modes as described above and additional elements for switching from one mode to the other, the two modes not being able to operate simultaneously. Many constituent elements necessary for each mode may be the same, namely the elements Cond, Evap, CT, CT', most of the controlled valves and certain portions of the $G_T$ and $L_T$ circuits. It is therefore unnecessary to duplicate these elements in the multipurpose modified Carnot machine. Other elements are specific to one particular mode. For example, the device PED, combining the chamber ABCD with the solenoid valves $SV_3$ and $SV_4$, as described in FIG. 2, allows the machine to operate in driving mode of the 2nd type but not to operate in the receiving mode of the 2nd type, as described in FIG. 7. The converse is not true, that is to say the device PED combining the chamber ABCD with the solenoid valves $SV_3$ and $SV_4$, as described in FIG. 7, does allow the machine to operate in receiving mode of the 2nd type or in driving mode of the 2nd type. A second example of the incompatibility of usage in the two modes also relates to the PED devices, but for the modified Carnot machines of the 1st type: the auxiliary hydraulic pump $AHP_1$ (FIG. 5) cannot provide the function of expanding the working fluid, like the expansion valve EV or the capillary tube C (FIG. 9), and vice versa. Likewise, the hydraulic converter is either a pump or a motor. However, there are converters that can provide both functions, depending on the direction of flow of the fluid.

Figure 11:
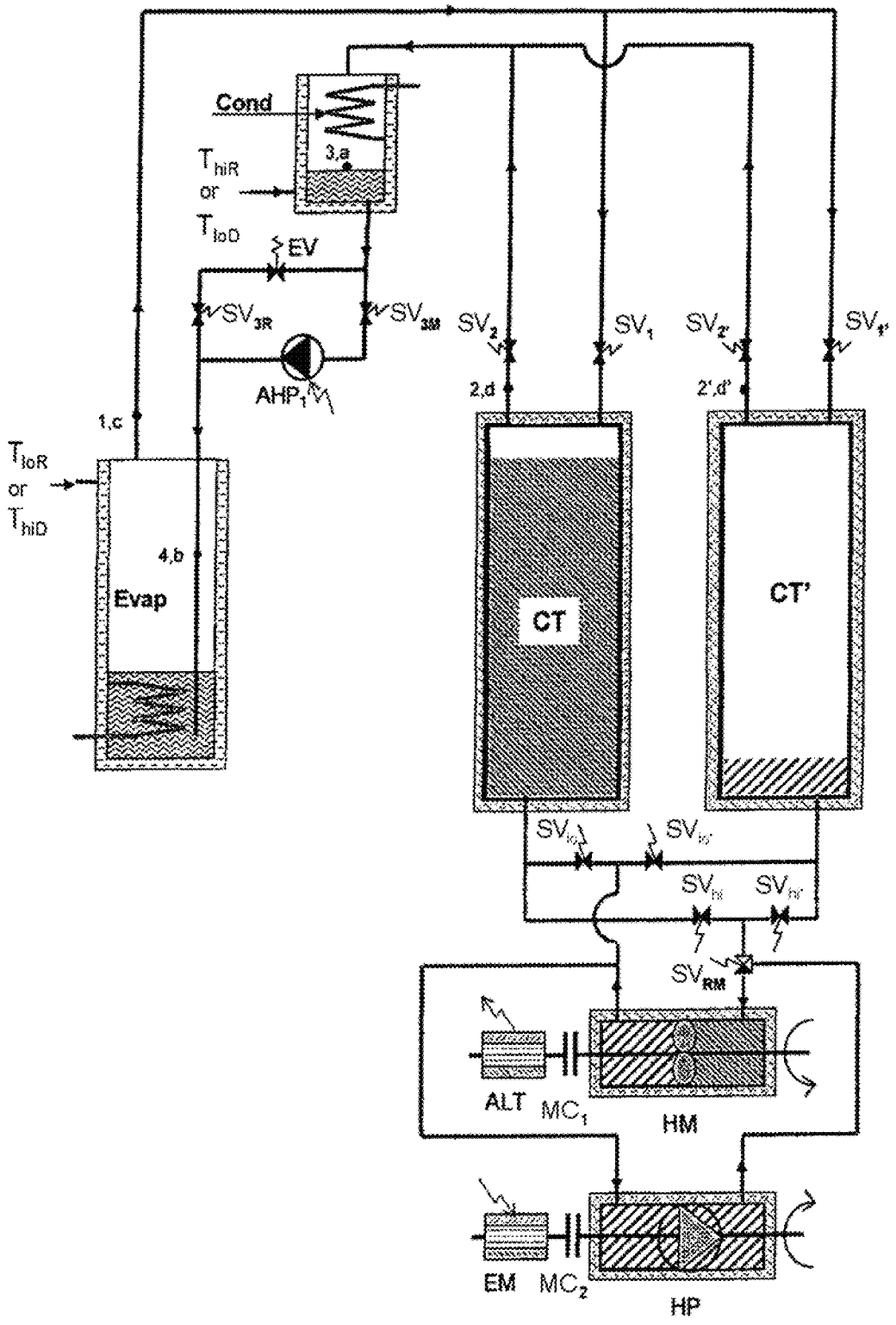
FIG. 11 shows a schematic view of a modified Carnot machine that can operate depending on the choice of the user in the 1st driving mode or in the 1st receiving mode.

FIG. 11 shows schematically a multipurpose modified Carnot machine that can provide, depending on the user's choice, either the function of a modified driving Carnot machine of the 1st type or the function of a modified receiving Carnot machine of the 1st type. The other three combinations of the two types are also possible, namely driving and receiving modes of the 2nd type, driving mode of the 1st type and receiving mode of the 2nd type, and driving mode of the 2nd type and receiving mode of the 1st type. To select the operating (driving or receiving) mode requires no sophisticated means. For example, in FIG. 11, the solenoid valves $SV_{3D}$ and $SV_{3R}$ are open and closed, or closed and open respectively, if the driving mode or the receiving mode is selected respectively. These two solenoid valves $SV_{3n}$ and $SV_{3R}$ may be replaced by a three-way valve. Finally, again in this example shown in FIG. 11, the hydraulic pump and the hydraulic motor are considered as two separate hydraulic converters. Depending on the operating mode selected, namely driving or receiving mode, one or other of the converters is active according to the opening of the three-way solenoid valve $SV_{RD}$, it being possible for said solenoid valve $SV_{RD}$ to be replaced by two two-way solenoid valves or any other actuator in the transfer liquid circuit.

In one particular embodiment, a modified Carnot machine may be coupled to a complementary device, by thermal coupling or by mechanical coupling.

A modified driving or receiving Carnot machine according to the invention may be thermally coupled at its condenser and/or its evaporator to a complementary device. The thermal coupling may be achieved by means of a heat-transfer fluid or a heat pipe, or by direct contact or by radiation.

The complementary device may be a driving or receiving thermodynamic machine. The two most advantageous cases relate to the coupling of a modified driving Carnot machine to a driving thermodynamic machine or the coupling of a modified receiving Carnot machine to a receiving thermodynamic machine. In both cases, the driving thermodynamic machine or the receiving thermodynamic machine receives heat from the condenser of the modified driving Carnot machine or the modified receiving Carnot machine respectively or gives heat to the evaporator of the modified driving Carnot machine or the modified receiving Carnot machine respectively. Said driving or receiving thermodynamic machines may be a second modified driving Carnot machine (of the 1st type or of the 2nd type) or a modified receiving Carnot machine different from the first one (of the 1st type or of the 2nd type).

Figure 12:
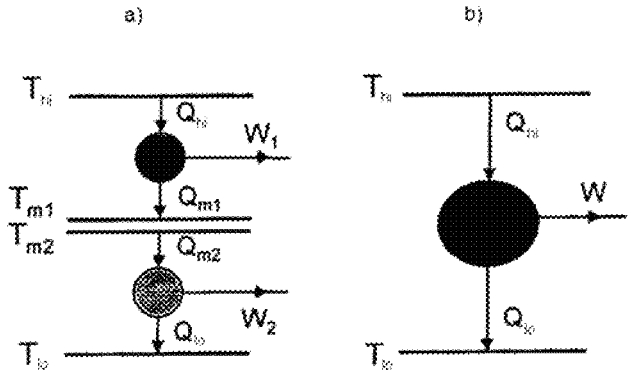
FIGS. 12*a* and 12*b* illustrate schematically two embodiments of modified driving Carnot machines operating between the same extreme temperatures $T_{hi}$ and $T_{lo}$, these figures indicating the direction of heat exchange and work exchange between these machines and the environment.

One mode of thermally coupling two modified driving Carnot machines is illustrated schematically in FIGS. 12*a* and 12*b*. FIG. 12*a* shows the temperature levels of the heat sources and heat sinks and the direction of heat exchange and work exchange between the machines or with the environment. A first, high-temperature (HT) machine operates between a heat source at the temperature $T_{hi}$ and a heat sink at the intermediate temperature $T_{m1}$ and contains a working fluid $G_{T1}$. A second, low-temperature (LT) machine operates between a heat source at $T_{m2}$ and a heat sink at the temperature $T_{lo}$, and it contains a working fluid $G_{T2}$. The temperatures are such that $T_{hi}>T_{m1}>T_{m2}>T_{lo}>T_{ambient}$. If the heat transfers at the condenser of the HT machine and the evaporator of the LT machine are infinitely efficient (because of an infinite exchange area and/or infinite exchange coefficients), the temperatures $T_{m1}$ and $T_{m2}$ are practically equal. In all cases, in this combination called a "thermal cascade" combination, the amount of heat $Q_{hi}$ is delivered to the HT machine at the temperature $T_{hi}$ in order to evaporate the fluid $G_{T1}$, the amount of heat $Q_{m1}$ released by the condensation of $G_{T1}$ in the condenser of the HT machine at the temperature $T_{m1}$ is entirely transferred ($Q_{m1}=Q_2$) or partially transferred ($Q_{m1}>Q_{m2}$) to the evaporator of the LT machine to evaporate the fluid $G_{T2}$ at the temperature $T_{m2}$, and the heat $Q_{lo}$ produced at the temperature $T_{lo}$ by the condensation of the fluid $G_{T2}$ is transmitted to the environment. When only work production is required, the heat transfer between the source at $T_{m1}$ and the sink at $T_{m2}$ is complete, that is to say there is equality between $Q_{m1}$, and $Q_{m2}$, denoted simply by $Q_m$, in this case. When work and heat cogeneration is desired at a sufficient temperature level such as $T_{m1}$, then the heat transfer between the source at $T_{m1}$ and the sink at $T_{m2}$ is partial, that is to say $Q_{m1}$ is greater than $Q_{m2}$ and the difference is delivered to the user.

Optionally, the working fluids $G_{T1}$ and $G_{T2}$ may be identical. In parallel, the amounts of work $W_1$ and $W_2$ are delivered by the HT machine and the LT machine respectively. The overall efficiency ($(W_1+W_2)/Q_{hi}$) of the cascaded combination of the two modified driving machines is not necessarily equal to, but in general somewhat lower than, that of a modified driving Carnot machine alone operating between the same extreme temperatures $T_{hi}$ and $T_{lo}$, as shown schematically in FIG. 12*b*. In fact, these two efficiencies are the same under the quadruple conditions that the two modified Carnot machines are of the 2nd type and operate ideally, that is to say with no irreversibilities, that the temperatures $T_{m1}$ and $T_{m2}$ are coincident and that there is integral heat recovery ($Q_{m1}=Q_{m2}$) at this intermediate temperature $T_m$.

The thermally cascaded combination of modified driving Carnot machines may involve machines of the same (1st or 2nd) type or machines of different types.

A first advantage of the cascaded combination of two modified driving Carnot machines of the 2nd type lies in the fact that the temperature difference $T_{hi}-T_{lo}$ is no longer limited as when a single modified driving Carnot machine of the 2nd type is used (due to the condition on the densities expressed by equation (1)). Thus, the overall efficiency of the cascaded combination may again become higher than that of the single machine when the difference ($T_{hi}-T_{lo}$) of said combination becomes greater than the maximum difference permitted for said single machine.

A second advantage of the cascaded combination of two modified driving Carnot machines of the 1st or 2nd type is that the pressure of each of the working fluids $G_{T1}$ and $G_{T2}$ is lower than that of the working fluid of the single modified driving Carnot machine (of the 1st or 2nd type) operating between the same extreme temperatures $T_{hi}$ and $T_{lo}$.

Cascaded coupling may be achieved using more than two modified driving Carnot machines according to the same principle. The first machine is supplied with heat at the highest temperature $T_{hi}$ to evaporate a working fluid, and the last machine of the cascade releases the heat, generated by condensation at the lowest temperature $T_{lo}$, into the environment, $T_{lo}$ nevertheless being above the temperature of said environment. Between these two extreme machines, each intermediate machine receives the heat released by the condensation of the working fluid of the preceding machine and transfers the heat released by the condensation of its own working fluid to the machine that follows it. Each machine delivers an amount of work to the environment.

Two modified receiving Carnot machines may be coupled in cascade in a manner similar to that described above in the case of the driving machines. The work flux and the heat flux are in the opposite directions to those shown in FIG. 12*a*.

The cascaded combination of two modified receiving Carnot machines has the not insignificant advantage of reducing the pressure of each of the working fluids $G_{T1}$ and $G_{T2}$ relative to that of the working fluid found in the case of a single modified receiving Carnot machine, whether of the 1st type or the 2nd type, operating between the same extreme temperatures $T_{lo}$ and $T_{hi}$.

A modified Carnot machine according to the invention may be mechanically coupled to a complementary device at the hydraulic motor if the machine is a driving machine or at the hydraulic pump if the machine is a receiving machine. The mechanical coupling may be achieved for example by means of a belt, a universal joint, a magnetic or nonmagnetic clutch, or directly onto the shaft of the hydraulic motor or of the hydraulic pump.

The complementary device may be a driving device, for example an electric motor, a hydraulic turbine, a wind turbine, a petroleum-driven engine, a gas-driven engine, a diesel engine, or another modified driving Carnot machine.

The complementary device may be a receiving device, for example a hydraulic pump, a transport vehicle, an alternator, a mechanical vapor compression heat pump, an air compressor, or another modified receiving Carnot machine.

The complementary device may also be a driving/receiving device, such as a flywheel for example.

One particularly preferred method of implementing mechanical coupling consists in coupling a modified driving Carnot machine to a modified receiving Carnot machine.

Figures 13, 14:
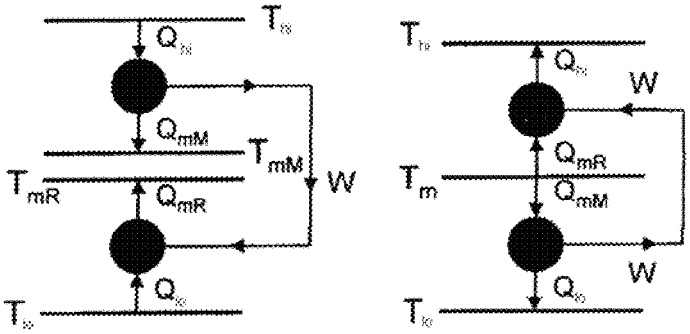
FIG. 13 shows schematically the heat source and sink temperature levels and the direction of heat exchange and work exchange in a plant comprising a high-temperature modified driving Carnot machine mechanically coupled to a low-temperature modified receiving Carnot machine.
FIG. 14 shows schematically the heat source and sink temperature levels and the direction of heat exchange and work exchange in a plant comprising a low-temperature modified driving Carnot machine mechanically coupled to a high-temperature modified receiving Carnot machine.

A first embodiment of a plant comprising a modified driving Carnot machine mechanically coupled to a modified receiving Carnot machine is shown schematically in FIG. 13 together with the temperature levels of the heat sources and heat sinks and the direction of heat exchange and work exchange.

The driving machine contains a working fluid $G_{T1}$. It receives an amount of heat $Q_{hi}$ from a source at the temperature $T_{hi}$, it releases an amount of heat $Q_{mD}$ at a temperature $T_{mD}$ and work W. The temperature $T_{hi}$ of the source is necessarily above the temperature $T_{mD}$ of the heat sink.

The receiving machine contains a working fluid $G_{T2}$. It releases an amount of heat $Q_{mR}$ at a temperature $T_{mR}$. It receives an amount of heat $Q_{lo}$ from a source at the temperature $T_{lo}$ and the work W released by the driving machine. The temperature $T_{lo}$ of the source is necessarily below the temperature $T_{mR}$ of the heat sink.

The two main applications intended by such a combination, which uses only heat at $T_{hi}$ as single energy source, are:

refrigeration production at $T_{lo}$: in this case $T_{lo}<T_{ambient}\leq T_{mR}$; and heat production at $T_{mR}$ and $T_{mD}$: for example for heating a dwelling, that is to say when $T_{lo}$ is the ambient temperature on the outside $T_{ambient_outside}$, the two average temperatures $L_{mD}$ and $T_{mR}$ are equal and the coefficient of amplification $(Q_{mR}+Q_{mD})/Q_{hi}$ is greater than 1.

A second embodiment of a plant comprising a modified driving Carnot machine mechanically coupled to a modified receiving Carnot machine is shown schematically in FIG. 14 together with the temperature levels of the heat sources and the heat sinks and the direction of heat exchange and work exchange.

The driving machine contains a working fluid $G_{T2}$. It receives an amount of heat $Q_{mD}$ from a source at the temperature $T_m$, it releases an amount of heat $Q_{lo}$ at a temperature $T_{lo}$ and work W. The temperature $T_m$ of the source is necessarily above the temperature $T_{lo}$ of the heat sink.

The receiving machine contains a working fluid $G_{T1}$. It releases an amount of heat $Q_{hi}$ at a temperature $T_{hi}$. It receives an amount of heat $Q_{mR}$ from the source at the temperature $T_m$ and work W released by the driving machine. The temperature $T_m$ of the source is necessarily below the temperature $T_{hi}$ of the heat sink.

Such a plant according to the invention makes it possible to obtain an amount of heat at a higher temperature than the temperature of the available heat source without consuming work delivered by the environment. This application is particularly advantageous when there is discharge of unutilized heat and when heat is required at a higher temperature.

A plant according to the present invention may be used to produce, from a heat source, electricity, heat or refrigeration. Depending on the application in question, the plant comprises a modified driving Carnot machine or a modified receiving Carnot machine associated with an appropriate environment. The working fluid and the hydraulic transfer liquid are chosen according to the desired objective, the temperature of the available heat source and the temperature of the available heat sink.

A modified receiving Carnot machine may be used in the entire field of refrigerating machines and heat pumps: freezing, refrigeration, "reversible" air conditioning, that is to say cooling in summer and heating in winter.

Conventional MVC (mechanical vapor compression) refrigerating machines are reputed to have a good coefficient of performance COP ($=Q_{lo}/W$) or a good coefficient of amplification COA ($=Q_m/W$). In fact, these coefficients are much lower (by about 50%) than those of the Carnot machine and therefore of the modified receiving Carnot machine of the present invention, in particular of the 2nd type, and to a lesser extent of the 1st type. By replacing current MVC machines with modified receiving Carnot machines it is possible to reduce the electrical energy needed to meet the same requirements.

As in the case of conventional CMV heat pumps, the reasonable pressure range for the working fluid $G_T$ of a modified receiving Carnot machine lies between 0.7 bar and 10 bar approximately. At pressures below 0.7 bar, the size of the pipes between the transfer cylinder and the evaporator and, most particularly, the volume of the transfer cylinder itself would become too large. Conversely, at pressures above 10 bar, safety and material strength problems arise. The use of alkanes or HFCs is very suitable for these applications. For example, isobutane has already been used in current refrigerators or freezers (since isobutane has no effect on the ozone layer). The transfer liquid that may be associated with these alkanes in a modified receiving Carnot machine for refrigerating applications is water. For refrigerating below 0° C., it would however be necessary in this case to insert a membrane between $G_T$ and $L_T$ so as to prevent any icing from obstructing the interior of the evaporator or to envisage regular deicing operations and devices for returning $L_T$ to the transfer chambers. Instead of water as transfer liquid, it is also conceivable to use an oil in which the chosen working fluid $G_T$ is weakly miscible.

The modified driving Carnot machines may be used for centralized or dispersed electricity generation, work production for pumping water, seawater desalination, etc., or the production of work for a dithermal receiving machine, i.e. one for the purpose of heating or for refrigerating, and in particular a modified receiving Carnot machine.

The advantages of a modified driving Carnot machine and those of a modified receiving Carnot machine may be added together by combining the two machines. Indeed, the mechanical-electrical conversion is then no longer necessary, thereby obviating the slight loss of efficiency that such a conversion involves.

A plant according to the invention may be used for the centralized generation of electricity from a centralized high-temperature heat source, for example produced by a nuclear reaction. A nuclear reaction produces heat at 500° C. The use of this heat involves either the use of a driving fluid compatible with this high temperature or the implementation of an intermediate step using a steam turbine, the steam being superheated to between 500 and 300° C. and the heat at 300° C. then being delivered to a modified driving Carnot machine that operates between this heat source at 300° C. and the cold sink of the external environment. With such a temperature difference, it is necessary for at least two modified driving Carnot machines involving different working fluids to be thermally cascaded. For the machine at the highest temperature, water is best suited as working fluid. In this configuration, the advantage afforded by the invention is that the overall electrical generation efficiency is better than that of current nuclear power stations.

An installation according to the invention may be used for decentralized electricity generation, using solar energy as heat source, this being renewable and available everywhere, albeit intermittent and quite dilute (with a maximum of about 1 $kW/m^2$ in fine weather). Current cylindro-parabolic solar collectors may bring the driving fluid to about 300° C. Compared with centralized generation, the work delivered by the turbine between 500 and 300° C. is lost but only a renewable energy source is used.

It is also possible to use thermal solar energy delivered at lower temperatures, such as about 130° C., with vacuum tube collectors or about 80° C. with flat collectors. Obviously the lower the temperature of the hot source, the lower the efficiency of the modified driving Carnot machine. However for the lowest temperature $T_{hi}$, that delivered by flat solar collectors, a thermally cascaded combination is no longer necessary; the modified driving Carnot machine is then simpler and therefore less expensive. When the sun is not shining, an auxiliary boiler may supply the necessary heat.

A plant according to the invention may be used to convert heat into work, without necessarily converting it into electricity. The mechanical work may be used directly, for example for a hydraulic pump or for a heat pump, the compressor of which is not driven by an electric motor. In the latter case, the end results are:

heat production at a temperature $T_m$ below that of the hot source at $T_{hi}$ but with a coefficient of amplification greater than 1, or at a temperature $T_{hi}$ above that of the hot source at $T_m$, but with a coefficient of amplification less than 1, said coefficients of amplification being greater than those of the prior art using adsorption or absorption systems; and refrigeration at a temperature $T_{lo}$ (below room temperature) and with a coefficient of performance greater than that of the prior art using adsorption or absorption systems.

The present invention is illustrated by the following eight examples to which the invention is not however limited. FIGS. 15*a* to 15*h* show schematically, for each of the examples, the heat exchange and work exchange between the modified Carnot machine (or combinations of said machines) and the environment, and also the temperatures of the heat sources and heat sinks.

Example 1 (FIG. 15*a*): three thermally cascaded modified driving Carnot machines of the 2nd type;

Example 2 (FIG. 15*b*): two thermally cascaded modified driving Carnot machines of the 1st type;

Examples 3 and 4 (FIGS. 15*c* and 15*d*): modified receiving Carnot machines of the 2nd or 1st type;

Example 5 (FIG. 15*e*): two thermally cascaded modified receiving Carnot machines of the 1st type;

Examples 6 and 7 (FIGS. 15*f* and 15*g*): mechanical coupling between a high-temperature modified driving Carnot machine of the 1st type and a low-temperature modified receiving Carnot machine of the 1st type; and Example 8 (FIG. 15*h*): mechanical coupling between a low-temperature modified driving Carnot machine of the 1st type and a high-temperature modified receiving Carnot machine of the 1st type.

Figure 16:
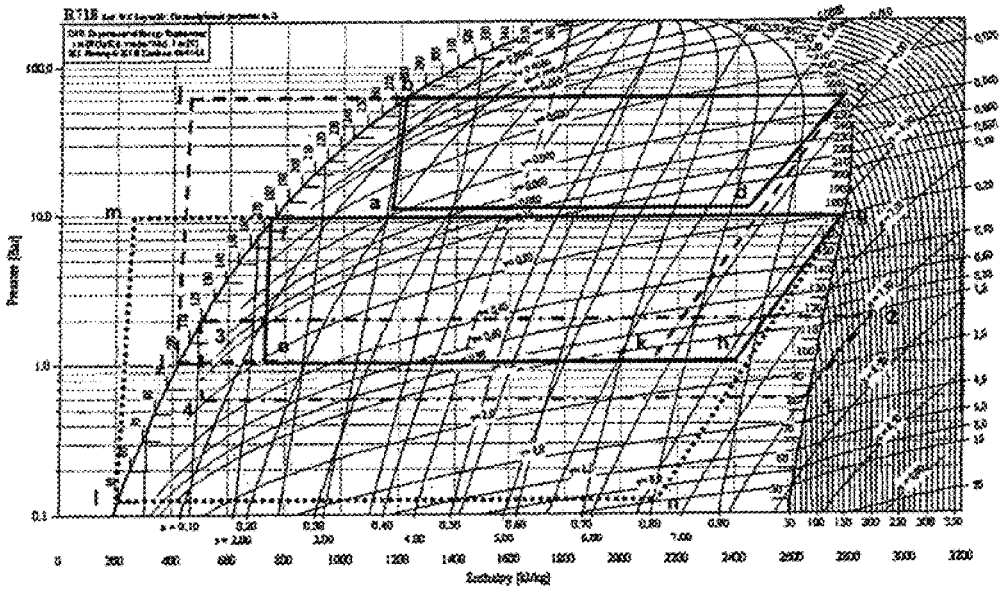
FIGS. 16, 17 and 18 show, in Mollier diagrams for water, n-butane and 1, 1,1,2-tetrafluoroethane, the various modified Carnot cycles involved in the 8 examples of FIG. 15.
Figure 17:
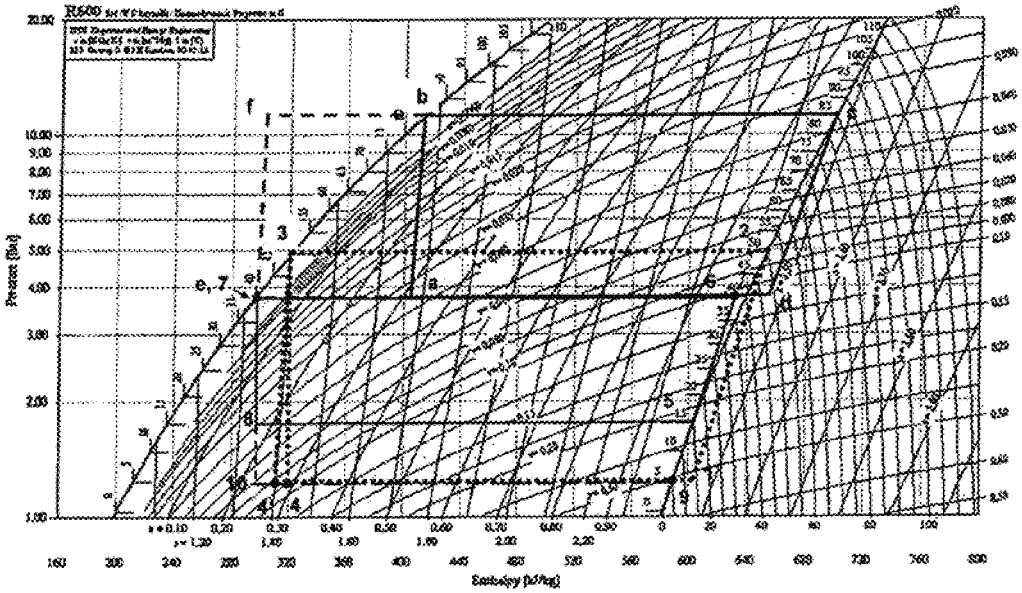
Figure 18:
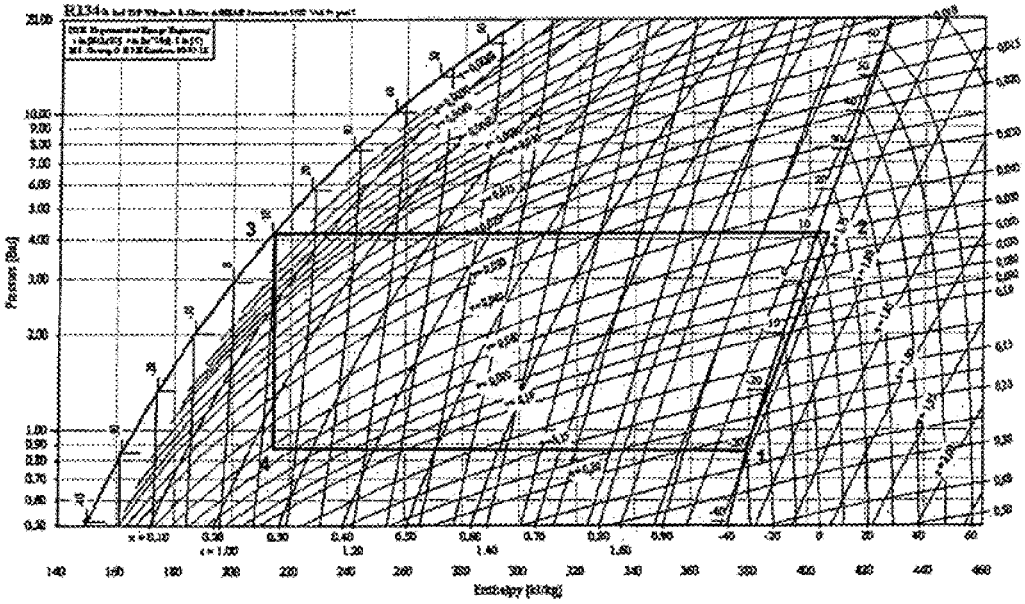

In these examples, three working fluids $G_T$ are used, namely water (denoted by R718), n-butane (denoted by R600) and 1,1,1,2-tetrafluoroethane (denoted by R134a). The Mollier diagrams for these three fluids are shown in FIGS. 16, 17 and 18 respectively. Plotted in these diagrams are the various modified Carnot cycles that are involved in the above-mentioned examples 1 to 8.

Example 1

Thermally Cascaded Combination of Three Modified Driving Carnot Machines of the 2nd Type The objective is to produce work (which can be converted to electricity) with the best efficiency possible. For a given cold sink temperature ($T_{lo}$=40° C.), the efficiency will be higher the higher the temperature $T_{hi}$ of the hot source and the closer the machine cycle is to the ideal Carnot cycle. The modified driving Carnot cycle of the 2nd type is therefore used in its preferred configuration, that is to say by satisfying the constraint whereby the density of the working fluid leaving the condenser is the same as that leaving the evaporator (as described in FIG. 4).

With a heat source at $T_{hi3}$ of 85° C., the working fluid used is 8600 and this describes the a-b-c-d-a cycle shown in FIG. 17. It should be noted that with this fluid, the c→d adiabatic expansion results in the vapor being in the superheated domain, but nevertheless very close to the saturation curve. The irreversibility is very low. The efficiency $\eta_3$ of this cycle is 12.49% compared with 12.56% for a perfect Carnot cycle between the same temperatures.

With a heat source at $T_{hi2}$ of 175° C. and in thermal cascade with the preceding cycle, the working fluid used is R718 and this describes the e-f-g-h-e cycle shown in FIG. 16. It should be noted that with this fluid, the g→h adiabatic expansion results in the fluid being in the two-phase domain and therefore causes no irreversibility. The efficiency $\eta_2$ of this cycle is coincident with that of a Carnot cycle, therefore 16.7%.

Finally, with a heat source at $T_{hi1}$ of 275° C. and in thermal cascade with the preceding cycle, the working fluid used is again R718, and this describes the a-b-c-d-a cycle shown in FIG. 16. The c→d adiabatic expansion again results in the two-phase domain. The efficiency $\eta_1$ of this cycle is 16.4%.

The thermally cascaded combination of these three modified driving Carnot machines of the 2nd type (FIG. 15*a*), with realistic temperature differences at the heat transfer level between the various machines, results in the following overall efficiency:

$$\eta=(W_1+W_2+W_3)/Q_{hi}=\eta_1+\eta_2(1-\eta_1)+\eta_3(1-\eta_2)(1-\eta_1)$$

giving $\eta$=39.10%, i.e. 91% of the efficiency of the Carnot machine operating between the same extreme temperatures.

This efficiency is better than that of current nuclear power stations (≈34%) which nevertheless work with superheated steam at much higher temperatures (≈500° C.). Furthermore, the heat source at $T_{hi1}$ (=275° C.) could be supplied by cylindro-parabolic solar collectors.

Example 2

Thermally Cascaded Combination of Two Modified Driving Carnot Machines of the 1st Type As for the previous example, the objective is to produce work (which can be converted to electricity) but with a simpler machine using combinations of modified driving Carnot machines of the 1st type. The temperature differences between the heat source and the heat sink are no longer limited by the constraint of the density of the working fluid leaving the condenser having to be the same as that leaving the evaporator. However, excessively large pressure differences generate other technological problems; thus, using the same extreme heat source and heat sink (275° C. and 40° C.), it is preferable for two machines to be thermally cascaded rather than to have a single machine operating over such a large pressure difference.

The thermal cascading (FIG. 15*b*) consists in coupling two modified driving Carnot machines of the 1st type: the first uses water (R718) as working fluid and describes the i-j-b-c-k-i cycle shown in FIG. 16, while the second uses n-butane (R600) as working fluid and describes the e-f-b-c-d-e cycle shown in FIG. 17.

Steps j→b and f→b of these two cycles cause additional irreversibilities, but the efficiencies of the two cycles nevertheless remain very satisfactory (in comparison with the Carnot efficiency): $\eta_1$=27.47% for the cycle with R718 and 12=10.82% for the cycle with R600.

The overall efficiency of the thermally cascaded combination (FIG. 15*b*) of these two modified driving Carnot machines of the 1st type is:

$$\eta=(W_1+W_2)/Q_{hi}=\eta_1+\eta_2(1-\eta_1)$$

i.e. $\eta$=35.32% (82% of the efficiency of the Carnot machine operating between the same extreme temperatures).

Compared with the previous example, for quite a small degradation in the efficiency (−3.78%), the simplification of the machine is relatively substantial: two combined machines instead of three, and most particularly those of the 1st type which are simpler than those of the 2nd type.

Example 3

Modified Receiving Carnot Machines of the 2nd or 1st Type

Figure 15:
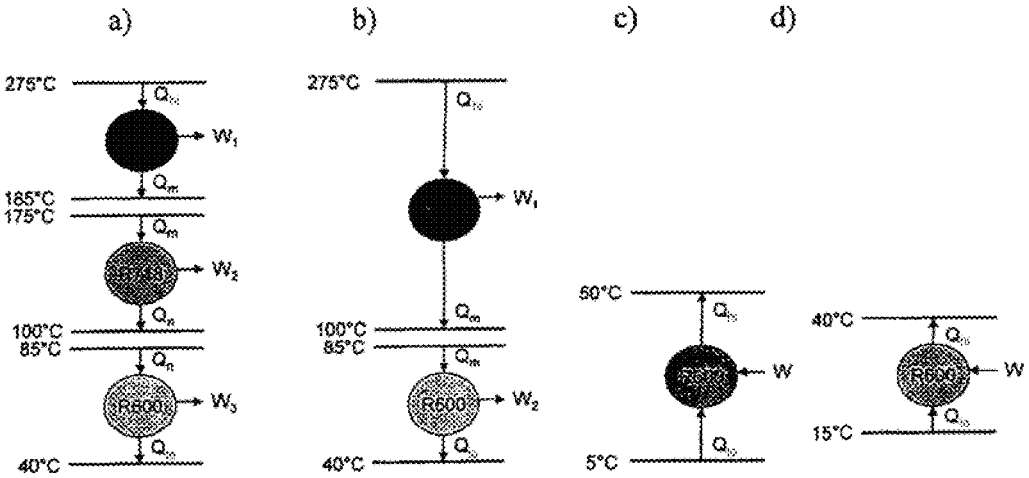
FIGS. 15*a* to 15*h* show schematically the heat and work exchange between a modified Carnot machine (or combinations of such machines) and the environment, and also the heat source and sink temperatures, for 8 examples involving various working fluids.
Figure 15:
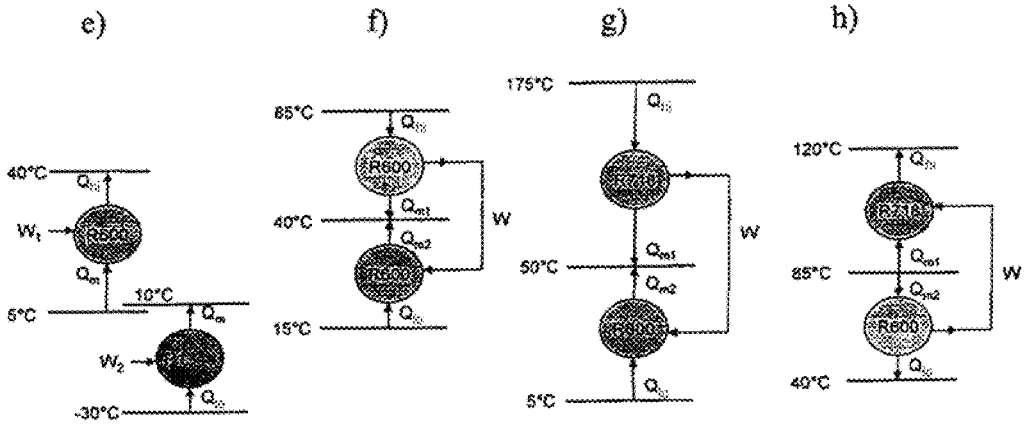

The intended objective in Example 3 is the heating of a dwelling by low-temperature emitters (radiators or underfloor heating). A modified receiving Carnot machine operating between 5 and 50° C. is very suitable for this application (FIG. 15*c*).

The two possible options, that the machines of the 2nd type or the machines of the 1st type constitute, using R600 as working fluid, are compared.

With a modified receiving Carnot machine of the 2nd type, the cycle described is the 1-2-3→4'-9-1 cycle shown in FIG. 17. With this fluid, if the adiabatic compression step had been carried out starting from the saturated vapor, that is to say the point "9" of this cycle, said fluid at the end of this step would have been in the two-phase domain, which is not a drawback. As an illustration in this example, it is chosen to superheat the fluid slightly (i.e. step 9→1) such that there is only saturated vapor at the end of compression (point "2" of the cycle). This implies, during said step, a supply of heat, for example at the transfer cylinders as illustrated in FIG. 2 for a modified driving Carnot machine.

The coefficient of amplification of this modified receiving Carnot machine describing this cycle is:

$$COA=Q_{hi}/W=7.18.$$

This COA is virtually the same as that of the Carnot machine operating between the same extreme temperatures since the irreversibility caused by the 9→1 superheating is very small.

However, the machine of the 2nd type requires the chamber ABCD and the associated connections, incurring a cost and involving more complex management of the cycle. With a modified receiving Carnot machine of the 1st type, the cycle described is the 1-2-3-4-9-1 cycle shown in FIG. 17. The COA of this machine of the 1st type is lower: $COA=Q_{hi}/W=6.06$, i.e. 84% of the COA of the Carnot machine, but it nevertheless remains much better than the COA values for current MVC machines operating between the same extreme temperatures.

Example 4

Modified Receiving Carnot Machine of the 1st Type

The intended objective in Example 4 is to cool a dwelling in summer.

A modified receiving Carnot machine of the 1st type operating between 15 and 40° C. is very suitable for this application (FIG. 15*d*). The working fluid used (R600) describes the 5-6-7-8-5 cycle shown in FIG. 17. Compared with the previous example, it is chosen not to superheat the fluid before the isentropic compression step. The coefficient of performance of this modified receiving Carnot machine describing this cycle is:

$COP=Q_{lo}/W=10.33$, i.e. 90% of the COP of the Carnot machine and in particular much better than the COP values of current MVC machines operating between the same extreme temperatures.

Example 5

Thermally Cascaded Combination of Two Modified Receiving Carnot Machines of the 1st Type The intended objective in Example 5 is low-temperature refrigeration (for freezing purposes). Even though the temperature difference between the heat source and heat sink is not limited by any constraint on the densities of the working fluid being equal, it is preferable for there not to be too high a pressure difference in the machine as this generates other technological problems. Thus with the cold source at −30° C. and the hot sink at 40° C., it is preferable for two machines to be thermally cascaded rather than providing a single machine operating over such a large temperature difference. The thermal cascading (see FIG. 15*e*) consists in coupling two modified receiving Carnot machines of the 1st type: the first uses R600 as working fluid and describes the 9-6-7-10-9 cycle shown in FIG. 17 and the second uses R134a as working fluid and describes the 1-2-3-4-1 cycle shown in FIG. 18.

The overall coefficient of performance of the thermally cascaded combination of these two modified receiving Carnot machines of the 1st type is:

$$COP=Q_{lo}/(W_1+W_2)=1/[1/COP_2+(1+1/COP_2)/COA_1].$$

This gives COP=2.85, i.e. 82% of the COP of the Carnot machine and above all much better than the COP values of current two-stage MVC machines operating between the same extreme temperatures.

Example 6

Mechanical Coupling Between a High-Temperature Modified Driving Carnot Machine of the 1st Type and a Low-Temperature Modified Receiving Carnot Machine of the 1st Type The intended objective in Example 6 (FIG. 150 is to cool a dwelling in summer using as energy source only heat, for example coming from solar collectors. To do this, a first machine—the modified driving Carnot machine of the 1st type using the working fluid R600, described in Example 2—is coupled to a second machine, the modified receiving Carnot machine of the 1st type described in Example 4.

The coefficient of performance of this combination (FIG. 15*f*) is: $COP=Q_{lo}/Q_{hi}=\eta_1 COP_2=1.29$, i.e. 89% of the COP of the trithermal Carnot machine and most particularly much better than the COP values for adsorption or absorption trithermal systems of the current prior art operating between the same heat sources and sinks.

Example 7

Mechanical Coupling of a High-Temperature Modified Driving Carnot Machine of the 1st Type and a Low-Temperature Modified Receiving Carnot Machine of the 1st Type The intended objectives in Example 7 (FIG. 15*g*) are several:

- cogeneration of work which can be converted to electricity and heat useful for (low-temperature) heating of a dwelling in winter;
- "low-temperature" air conditioning, i.e. compatible with conventional fan-coil units for buildings (especially offices or flats), in all cases using as energy source only heat at a temperature achievable by a boiler or by cylindro-parabolic solar collectors.

For these practical objectives, a first machine—the modified driving Carnot machine of the 1st type using the working fluid R718, which describes the l-m-g-n-l cycle shown in FIG. 16—is coupled to a second machine, the modified receiving Carnot machine of the 1st type described in Example 3.

The efficiency $\eta_1$ of the first machine is 25.34% (i.e. 91% of the Carnot efficiency), this being much higher than the current efficiency of photovoltaic solar collectors.

Although the electricity is not recovered for the receiving machine (FIG. 15*g*), the production of heat $Q_{m1}$ supplements the electricity generation, i.e. 24.66% of the incident energy $Q_{hi}$, whereas photovoltaic cells themselves deliver no heat. In the opposite case, that is to say for just heating and/or air conditioning applications, the coefficients of amplification and performance of this combination are joined to the COP and efficiency values of the two machines, as:

$$COA=COP+1=COP_{2\times}\eta_1+1,$$

giving, respectively, COA=2.28 (84% of the Carnot COA) and COP=1.28 (74% of the Carnot COA).

Example 8

Mechanical Coupling Between a Low-Temperature Modified Driving Carnot Machine of the 1st Type and a High-Temperature Modified Receiving Carnot Machine of the 1st Type The intended objective in Example 8 (FIG. 15*h*) is steam production at moderate pressure (2 bar), having, as sole energy source, "low-temperature" (85° C.) heat incompatible with direct production of said vapor. This is one example among others conventionally encountered on industrial sites where unutilized heat is discarded and where higher temperatures are required.

This thermotransformation objective between 85 and 120° C. (capable of generating vapor at 2 bar) may be carried out by mechanically coupling a first machine, namely the modified receiving Carnot machine of the 1st type, using R718, operating between 85 and 120° C. and describing the 1-2-3-4-1 cycle shown in FIG. 16, to a second machine, the modified driving Carnot machine of the 1st type, operating between 85° C. and 40° C. (which temperature is above the ambient temperature), using the working fluid R600 and described in Example 2.

The coefficient of performance $COP_1$ of the first (receiving) machine is 9.14 (89% of the COP of the dithermal Carnot machine). It should be noted that with water as working fluid, the steam at the end of the isentropic compression step is highly superheated ($T_2$=208° C.>>120° C.).

The overall coefficient of performance of the combination of the two machines (FIG. 15*h*) satisfies the equation:

$$COP=Q_{hi}/(Q_{m1}+Q_{m2})=(COP_1+1)/(COP_1+1/\eta_2),$$

giving, with these source and sink temperatures: COP=55.2% (89% of the COP of the trithermal Carnot machine).

The various examples described above confirm that one and the same working fluid may be used as driving fluid or as receiving fluid, depending on the plant and the intended objective.

The fluid n-butane (R600) describes a driving cycle of the 1st type in Example 2 (FIG. 15*b*) and a receiving cycle of the 1st type in Example 7 (FIG. 15*g*) and the modified Carnot machine, of the driving and receiving type respectively, which uses this fluid R600 is combined in these two examples with another Carnot machine, of the driving type in this case, using water (R718) as working fluid. Consequently, it may be deduced from this that a plant according to the present invention may comprise a driving Carnot machine of the 1st type (with R718 as working fluid) coupled to a multipurpose modified Carnot machine (such as that described in FIG. 11, with R600 as working fluid) and that such a plant may be employed for applications as different as that intended in Example 2 and that intended in Example 7.

The invention claimed is:

1. A refrigeration, heat or work production plant, comprising at least one modified Carnot machine formed by:

a) a 1st assembly that comprises an evaporator (Evap) associated with a heat source, a condenser (Cond) associated with a heat sink, a device (PED) for pressurizing or expanding a working fluid $G_T$, means for transferring the working fluid $G_T$ between the condenser (Cond) and the (PED) and between the evaporator (Evap) and the (PED);

b) a 2nd assembly that comprises two transfer chambers (CT) and (CT') that contain a transfer liquid $L_T$ and the working fluid $G_T$ in liquid and/or vapor form, the transfer liquid $L_T$ and the working fluid being two different fluids;

c) means for the selective transfer of the working fluid $G_T$ between the condenser (Cond) and each of the transfer chambers (CT) and (CT') on the one hand, and between the evaporator (Evap) and each of the transfer chambers (CT), and (CT') on the other; and d) means for the selective transfer of the liquid $L_T$ between the transfer chambers (CT) and (CT') and the compression or expansion device (PED), said means comprising at least one hydraulic converter.

2. The plant as claimed in claim 1, in which the modified Carnot machine is a driving machine, wherein the hydraulic converter is a hydraulic motor and the heat source is at a temperature above that of the heat sink, and in that the (PED) is a device that pressurizes the working fluid $G_T$, which is in the saturated liquid or supercooled liquid state.

3. The plant as claimed in claim 1, in which the modified Carnot machine is a driving machine, wherein the hydraulic converter is a hydraulic motor and the heat source is at a temperature above that of the heat sink, and in that the (PED) device comprises, on the one hand, a compression/expansion chamber (ABCD) and the transfer means associated therewith and, on the other hand, an auxiliary hydraulic pump ($AHP_2$) for pressurizing the transfer liquid $L_T$.

4. The plant as claimed in claim 1, in which the modified Carnot machine is a receiving machine, wherein the hydraulic converter is a hydraulic pump and the heat source is at a temperature below that of the heat sink, and in that the (PED) is an expansion valve (EV).

5. The plant as claimed in claim 1, in which the modified Carnot machine is a receiving machine, wherein the hydraulic converter is a hydraulic pump and the heat source is at a temperature below that of the heat sink, and in that the (PED) comprises a chamber (ABCD) for compressing or expanding, adiabatically, the working fluid $G_T$ by means of the transfer liquid $L_T$.

6. The plant as claimed in claim 1, where said plant comprises a modified Carnot machine thermally coupled at its condenser and/or its evaporator to a complementary device, the complementary device being a driving dithermal thermodynamic machine as modified driving Carnot machine and a receiving dithermal thermodynamic machine as modified receiving Carnot machine.

7. The plant as claimed in claim 6, wherein the coupling is achieved by means of a heat-transfer fluid or a heat pipe or by direct contact or by radiation.

8. The plant as claimed in claim 6, wherein the dithermal thermodynamic machine is a second modified Carnot machine.

9. The plant as claimed in claim 1, wherein the modified Carnot machine is mechanically coupled to a complementary device.

10. The plant as claimed in claim 9, wherein said plant comprises a modified receiving Carnot machine coupled to a complementary driving device or to a driving/receiving device, or it comprises a modified driving Carnot machine coupled to a complementary receiving device or to a driving/receiving device.

11. The plant as claimed in claim 10, wherein:

the complementary driving device is selected from the group consisting of an electric motor, a hydraulic turbine, a wind generator, a petroleum-driven engine, a gas-driven engine, a diesel engine, or a modified driving Carnot machine;

the complementary receiving device is selected from the group consisting of a hydraulic pump, a transport vehicle, an alternator, a mechanical vapor or gas compression heat pump, an air compressor or a modified receiving Carnot machine;

the complementary driving/receiving device is a flywheel.

12. The plant as claimed in claim 1, wherein said plant comprises either one of a heat exchanger integrated into the $L_T$ circuit or within side walls of transfer chambers (CT) and (CT'), either one of which configured to exchange heat between, on the one hand, the heat source and/or the heat sink, which are at different temperatures, and, on the other hand, the working fluid $G_T$ in the transfer chambers (CT and (CT'), which heat exchange may be direct or indirect.

13. The plant as claimed in claim 1, wherein the working fluid $G_T$ and the transfer liquid $L_T$ are chosen in such a way that $G_T$ is weakly soluble in $L_T$, $G_T$ does not react with $L_T$ and $G_T$ in the liquid state is less dense than $L_T$.

14. The plant as claimed in claim 1, wherein the working fluid $G_T$ and the transfer liquid $L_T$ are isolated from each other by a flexible membrane which creates an impermeable barrier between the fluids and $L_T$ but which offers only a very slight resistance to the displacement of $L_T$ and a slight resistance to the heat transfer, or by a float which has an intermediate density between that of the working fluid $G_T$ in the liquid state and that of the transfer liquid $L_T$.

15. The plant as claimed in claim 13, wherein the transfer liquid $L_T$ is chosen from the group consisting of water, mineral oils and synthetic oils.

16. The plant as claimed in claim 13, wherein the working fluid $G_T$ is a pure substance or an azeotropic mixture.

17. The plant as claimed in claim 13, wherein the working fluid $G_T$ is chosen from the group consisting of water, $CO_2$, $NH_3$, alcohols containing 1 to 6 carbon atoms, alkanes containing 1 to 18 carbon atoms, chlorofluoroalkanes containing 1 to 15 carbon atoms, partially or completely chlorinated alkanes containing 1 to 15 carbon atoms and partially or completely fluorinated alkanes containing 1 to 15 carbon atoms.

18. The plant as claimed in claim 1, wherein said plant is configured to conduct a refrigeration, heat and/or work production process consisting in subjecting a working fluid $G_T$ to a succession of modified Carnot cycles, wherein each modified Carnot cycle comprising the following $G_T$ transformations:

an isothermal transformation with heat exchange between $G_T$ and the heat source, or between $G_T$ and the heat sink;

an adiabatic transformation with a reduction in the pressure of the working fluid $G_T$;

an isothermal transformation with heat exchange between $G_T$ and the heat sink, or between $G_T$ and the heat source; and an adiabatic transformation with an increase in the pressure of the working fluid $G_T$, wherein:

the working fluid $G_T$ is in a liquid-gas two-phase form at least during the two isothermal transformations of a cycle; and the two isothermal transformations produce or follow a change in volume of $G_T$ concomitant with the displacement of a transfer liquid $L_T$ which drives or is driven by a hydraulic converter, and work is delivered or received by the plant by means of a transfer liquid $L_T$ which flows through a hydraulic converter during at least the two isothermal transformations.

19. The plant as claimed in claim 18, wherein work is received or delivered by the plant via the transfer liquid $L_T$ which flows through a hydraulic converter during just one of the adiabatic transformations.

20. The plant as claimed in claim 18, wherein work is received or delivered by the plant via the transfer liquid $L_T$ which flows through a hydraulic converter during both adiabatic transformations.

21. The plant as claimed in claim 18, wherein the cycle comprises the following transformations:

an isothermal transformation initiated by supplying heat to $G_T$ from the heat source;

an adiabatic transformation with a reduction in the pressure of the working fluid $G_T$ and production of work by the plant;

an isothermal transformation during which heat is delivered by $G_T$ to a heat sink at a temperature below that of the source; and an adiabatic transformation with an increase in the pressure of the working fluid $G_T$.

22. The plant as claimed in claim 21, wherein work is exchanged between the plant and the environment during both adiabatic transformations of the cycle.

23. The plant as claimed in claim 22, wherein the ratio $\rho_a/\rho_c$ is such that $0.9 \leq \rho_a/\rho_c \leq 1$, $\rho_a$ denoting the density of $G_1$ at the end of the step of exchanging heat with the heat sink and $\rho_c$ denoting the density of $G_T$ at the end of the step of exchanging heat with the heat source.

24. The plant as claimed in claim 18, wherein the cycle comprises the following transformations:

an isothermal transformation with the release of heat by $G_T$ to the heat sink;

an adiabatic transformation with a reduction in the pressure of the working fluid $G_T$;

an isothermal transformation with heat supplied to $G_T$ via the heat source at a temperature below the temperature of the heat sink; and an adiabatic transformation with an increase in the pressure of the working fluid $G_T$ initiated by supplying work via the transfer liquid $L_T$.

25. The plant as claimed in claim 18, wherein said plant includes a modified Carnot machine coupled to a dithermal thermodynamic machine, wherein the heat is transferred from the condenser of the modified Carnot machine to the thermodynamic machine, or the evaporator of the modified Carnot machine receives heat from the thermodynamic machine.

26. The plant as claimed in claim 18, wherein said plant includes first and second modified Carnot machines and optionally at least one intermediate modified Carnot machine between said first and second modified Carnot machines, the modified Carnot machines being thermally coupled, wherein:

the first machine is supplied with heat in order to evaporate a working fluid $G_{Tf}$ and the last machine releases the heat generated by condensing a working fluid $G_{Tl}$ into the environment, it being possible for said fluids $G_{Tf}$ and $G_{Tl}$ to be identical or different;

where appropriate, each intermediate machine receives the heat released by the condensation of the working fluid $G_{Ti-1}$ of the machine that precedes it and transfers the heat released by the condensation of its own working fluid $G_{Ti}$ to the machine that follows it, it being possible for said fluids $G_{Ti-1}$ and $G_{Ti}$ to be identical or different; and each machine exchanges an amount of work with the environment, and wherein the machines are all driving machines or all receiving machines and that:

when all the machines are driving machines, the heat delivered to the first machine is at the temperature $T_{hi}$ and the heat released by the last machine is at the temperature $T_{lo}<T_{hi}$, and net work is delivered to the environment; and when all the machines are receiving machines, the heat delivered to the first machine is at the temperature $T_{lo}$ and the heat released by the last machine is at the temperature $T_{hi}$ which is above both $T_{lo}$ and the temperature of the environment, and net work is delivered by the environment.

27. The plant as claimed in claim 3, said plant being configured to heat at a temperature $T_{lo}$ and/or work, wherein, starting from an initial state in which, on the one hand, the working fluid $G_T$ is maintained in the evaporator Evap at high temperature and in the condenser (Cond) at low temperature by heat exchange with the hot source at $T_{hi}$ and the cold sink at $T_{lo}$ ($<T_{hi}$) respectively and, on the other hand, all the circuits for communication between $G_T$ and the transfer liquid $L_1$ are closed off;

at time $t_\alpha$, the $G_T$ circuit between (Evap) and (CT') is opened, the $L_T$ circuit between (CT') and the upstream side of the hydraulic motor (HM) is opened and the auxiliary pump ($AHP_2$) is actuated so that:

the working fluid $G_T$ evaporates in (Evap) and the saturated $G_T$ vapor leaving (Evap) at the high pressure $P_{hi}$ enters (CT') and delivers $L_T$ at an intermediate level J;

$L_T$ passes through (HM), being expanded therein, and then $L_T$ is taken in by ($AHP_2$) and delivered to (ABCD);

at time $t_\beta$, the $G_T$ circuit between (ABCD) and (Evap) is opened so that the working fluid $G_T$ is introduced in the liquid state into the evaporator;

at time $t_\gamma$, the $G_T$ circuit between (Evap) and (CT') on the one hand and between (ABCD) and (Evap) on the other is closed, the auxiliary pump ($AHP_2$) is stopped, the $G_T$ circuit between (Cond) and (ABCD) on the one hand, and between (CT) and (Cond) on the other, is opened and the $L_T$ circuit between (CT) and (ABCD) is opened so that:

the $G_T$ vapor contained in (CT') continues to expand, adiabatically, and delivers $L_T$ to the low level in (CT') and then through (HM) to (CT);

the chamber (ABCD) in communication with (Cond) is brought back down to the low pressure and $L_T$ that it contains in its lower portion flows into (CT);

the $G_T$ vapor contained in (CT) condenses in (Cond):

at time $t_\delta$, all the circuits open at time $t_\square$ are closed, the $G_T$ circuit between (Evap) and (CT) is opened, the $L_T$ circuit between (CT) and the upstream side of the hydraulic motor (HM) is opened and the auxiliary pump ($AHP_2$) is actuated so that:

the saturated $G_T$ vapor leaving (Evap) at the high pressure $P_{hi}$ enters (CT) and delivers $L_T$ to an intermediate level J;

$L_T$ passes through (HM) being expanded therein, and then $L_T$ is taken in by ($AHP_2$) and delivered to (ABCD);

at time $t_\epsilon$, the $G_T$ circuit between (ABCD) and (Evap) is opened so that the working fluid $G_T$ is introduced in the liquid state into the evaporator;

at time $t_\gamma$, the $G_T$ circuit between (Evap) and (CT) on the one hand, and between (ABCD and (Evap) on the other, is closed, the auxiliary pump ($AHP_2$) is stopped, the $G_T$ circuit between (Cond) and (ABCD) on the one hand, and between (CT') and (Cond) on the other, is opened and the $L_T$ circuit between (CT') and (ABCD) is opened so that:

the $G_T$ vapor contained in (CT) continues to expand, adiabatically, and delivers $L_T$ to the low level in (CT) and then through (HM) to (CT');

the chamber (ABCD) in communication with (Cond) is brought back down to the low pressure and the $L_T$ that it contains in its lower portion flows into (CT'); and the $G_T$ vapor contained in (CT') condenses in the (Cond), wherein, after several cycles, the plant operates in a steady state in which the hot source continuously delivers heat at the temperature $T_{hi}$ to the evaporator (Evap), heat is continuously delivered by the condenser (Cond) to the cold sink at the temperature $T_{lo}$, and work is continuously delivered by the machine.

28. The plant as claimed in claim 2, wherein plat is configured to produce heat at a temperature $T_{lo}$ and/or work, wherein, starting from an initial state in which the working fluid $G_T$ is maintained in the evaporator (Evap) at high temperature and in the condenser (Cond) at low temperature by heat exchange with the hot source at $T_{hi}$ and the cold sink at $T_{lo}$ respectively, and all the communication circuits for the working fluid $G_T$ and for the transfer liquid $L_T$ are closed off, at time $t_0$ the auxiliary hydraulic pump ($AHP_1$) is actuated and the $G_T$ circuit between (Cond) and (Evap) is opened so that a portion of $G_T$, in the saturated or supercooled liquid state, is taken in by ($AHP_1$) into the lower portion of the condenser (Cond) and delivered in the supercooled liquid state into (Evap) where it is heated, and then $G_T$ is subjected to a succession of modified Carnot cycles, each of which comprising the following steps:

at time $t_\alpha$ when, during the first action cycle, some $G_T$ remains liquid in the condenser, the $G_T$ circuit between (Evap) and (CT') on the one hand, and between (CT) and (Cond) on the other, is opened and the circuit allowing $L_T$ to be transferred from (CT') to (CT), passing through the hydraulic motor (HM,) is opened, so that:

$G_T$ is heated and evaporates in (Evap), and the saturated $G_T$ vapor leaving Evap at the high pressure $P_{hi}$ enters (CT') and delivers $L_T$ to an intermediate level J;

$L_T$ passes through (HM,) being expanded therein, and then $L_T$ is delivered to (CT) up to the intermediate level I;

the $G_T$ vapor contained in (CT) and delivered by $L_T$ condenses in (Cond);

$G_T$ in the saturated or supercooled liquid state arrives in the lower portion of the condenser (Cond), where it is progressively taken in by ($AHP_1$) and then delivered in the supercooled liquid state to (Evap);

at time $t_\beta$ the $G_T$ circuit between (Evap) and (CT') is closed so that:

the $G_T$ vapor contained in continues to expand, adiabatically, and delivers $L_T$ up to the low level in (CT') and then through (HM) to (CT) where it reaches the high level;

the rest of the $G_T$ vapor contained in (CT) and delivered by the liquid $L_T$ condenses in (Cond);

$G_T$ in the saturated or supercooled liquid state arrives in the lower portion of the condenser (Cond), where it is progressively taken up by ($AHP_1$) and then delivered in the supercooled liquid state into (Evap;

at time $t_\gamma$, the circuits open at time $t_\beta$, except that for transferring $G_T$ between (Cond) and (Evap), are closed, the $G_T$ circuit between (Evap) and (CT) on the one hand, and between (CT') and (Cond) on the other, is opened and the circuit for transferring $L_T$ from (CT) to (CT'), passing via the hydraulic motor (HM, is opened so that:

$G_T$ heats up and evaporates in (Evap) and the saturated $G_T$ vapor leaving Evap at the high pressure $P_{hi}$ enters (CT) and delivers $L_T$ to an intermediate level J;

$L_T$ passes through (HM), being expanded therein, and then $L_T$ is delivered into (CT') up to the intermediate level I;

the $G_T$ vapor contained in (CT') and delivered by the liquid $L_T$ condenses in (Cond);

$G_T$ in the saturated or supercooled liquid state arrives in the lower portion of the condenser (Cond), where it is progressively taken up by ($AHP_1$) and then delivered in the supercooled liquid state into (Evap);

at time $t_\delta$, the $G_T$ circuit between (Evap) and (CT) is closed so that:

the $G_T$ vapor contained in (CT) continues to expand, adiabatically, and delivers $L_T$ up to the low level in (CT) and then through (HM) into (CT') where it reaches the high level;

the rest of the $G_T$ vapor contained in (CT') and delivered by the liquid $L_T$ condenses in (Cond); and $G_T$ in the saturated or supercooled liquid state arrives in the lower portion of the condenser (Cond), where it is progressively taken up by ($AHP_1$) and finally delivered in the supercooled liquid state into (Evap), wherein, after several cycles, the plant operates in a steady state in which the hot source continuously delivers heat at high temperature $T_{hi}$ to the evaporator (Evap), heat is continuously delivered by the condenser (Cond) to the cold sink at $T_{lo}$, and work is continuously delivered by the machine.

29. A method of managing a plant as claimed in claim 5, starting from an initial state in which all the communication circuits for the working fluid $G_T$ and the transfer liquid $L_T$ are closed off, wherein, at time $t_0$, the hydraulic pump (HP) is actuated and then $G_T$ is subjected to a succession of modified Carnot cycles, each of which comprising the following steps:

at time $t_\alpha$, the $L_T$ circuits for transferring, on the one hand, $L_T$ from the chamber (ABCD) to the upstream side of the hydraulic pump (HP) and, on the other hand, $L_T$ from (CT) into (CT') via the hydraulic pump (HP), are opened so that:

$G_T$ in the liquid/vapor equilibrium state in (ABCD) and in (CT) expands from the high pressure $P_h$ to the low pressure $P_{lo}$ and delivers $L_T$ through (HP) into (CT');

the $G_T$ vapor contained in (CT') is adiabatically compressed;

at time $t_\beta$, the $G_T$ circuit between (Evap) and (CT) on the one hand, and between (ABCD) and (Evap) on the other, is opened so that:

the transfer liquid $L_T$ is taken in by the pump (HP), which pressurizes it and delivers it into (CT');

the $L_T$ levels in (ABCD), (CT) and (CT') pass from high to low, high to an intermediate level J, and low to an intermediate level I, respectively;

because the volume occupied by the $G_T$ vapor in (CT) increases, $G_T$ evaporates in Evap and the saturated $G_T$ vapor leaving (Evap) at the low pressure $P_{lo}$ enters (CT);

the $G_T$ vapor contained in (CT') continues to be adiabatically compressed up to the high pressure $P_{hi}$; and $G_T$ in the saturated liquid state at the low pressure $P_{lo}$ flows under gravity from (ABCD) into (Evap);

at time $t_\gamma$, the $G_T$ circuit between (ABCD) and (Evap) is closed, the $L_T$ circuit between (ABCD) and the upstream side of the pump (HP) is dosed, the $G_T$ circuit between (CT') and (Cond) on the one hand, and between (Cond) and (ABCD) on the other, is opened and the $L_T$ circuit between the downstream side of the pump (HP) and (ABCD) is opened so that:

$L_T$ is again taken in by the pump (HP, which pressurizes it and delivers it into (CT');

the $L_T$ levels in (ABCD), (CT) and (CT') pass from low to high, from the intermediate level J to low, and from the intermediate level I to high respectively;

because the volume occupied by the $G_T$ vapor in (CT) continues to increase, $G_T$ evaporates in (Evap) and the saturated $G_T$ vapor leaving (Evap) at the low pressure $P_{lo}$ enters (CT);

the $G_T$ vapor contained in (CT'), at high pressure $P_{hi}$, is delivered by $L_T$ into and condenses in (Cond); and $G_T$ in the saturated liquid state flows under gravity from (Cond) to (ABCD);

at time $t_\delta$, all the circuits open at time $t_\gamma$ are dosed, the $L_T$ circuits for transferring $L_T$ on the one hand from the chamber (ABCD) to the upstream side of the hydraulic pump (HP, and on the other hand from (CT') into (CT) passing via the hydraulic pump (HP, are opened so that:

$G_T$ in the liquid/vapor equilibrium state in (ABCD) and in (CT') expands from the high pressure $P_{hi}$ to the low pressure $P_{lo}$ and delivers $L_T$ through (HP) into (CT); and the $G_T$ vapor contained in (CT) is adiabatically compressed;

at time $t_\epsilon$, the $G_T$ circuit between (Evap) and (CT') on the one hand, and between (ABCD) and (Evap) on the other, is opened so that:

$L_T$ is taken in by the pump (HP, which pressurizes it and delivers it into (CT);

the $L_T$ levels in (ABCD), (CT) and (CT') pass from high to low, from low to an intermediate level I, and from high to an intermediate level J respectively;

because the volume occupied by the $G_T$ vapor in (CT') increases, $G_T$ evaporates in (Evap and the saturated $G_T$ vapor leaving (Evap) at the low pressure $P_{lo}$ enters (CT');

the (1 vapor contained in (CT) continues to be adiabatically compressed up to the high pressure $P_{hi}$; and $G_T$ in the saturated liquid state at the low pressure $P_{lo}$ flows under gravity from (ABCD) into (Evap);

at time $t_\lambda$, the $G_T$ circuit between (ABCD) and (Evap) is closed, the $L_T$ circuit between (ABCD) and the upstream side of the pump (HP) is closed, the $G_T$ circuit between (CTv and (Cond) on the one hand, and between (Cond) and (ABCD) on the other, is opened and the $L_T$ circuit between the downstream side of the pump (HP) and (ABCDv is opened, so that:

is again taken in by the pump (HP), which pressurizes it and delivers it into (CT);

the $L_T$ levels in (ABCD), (CT) and (CT') pass from low to high, from the intermediate level I to high and from the intermediate level J to low respectively;

because the volume occupied by the $G_T$ vapor in (CT') continues to increase, $G_T$ evaporates in (Evap) and the saturated $G_T$ vapor leaving (Evap) at the low pressure $P_{lo}$ enters (CT';

the $G_T$ vapor contained in (CT), at high pressure $P_{hi}$, is delivered by $L_T$ into and condenses in (Cond); and $G_T$ in the saturated liquid state flows under gravity from (Cond) into (ABCD), wherein after several cycles, the plant operates in a steady state and that:

for refrigeration, in the initial state, $G_T$ is maintained in the condenser (Cond) at high temperature by heat exchange with the hot sink at $T_{hi}$ and in the evaporator (Evap) at a temperature equal to or below $T_{hi}$ by heat exchange with a medium external to the machine, said medium having initially a temperature $T_{hi}$, and in a steady state, net work is consumed by the hydraulic pump the condenser (Cond) continuously removes heat to the hot sink at high temperature $T_{hi}$ and heat is continuously consumed by the evaporator (Evap), with extraction of heat from the external medium in contact with said evaporator (Evap), the temperature $T_{lo}$ of said external medium being strictly below $T_{hi}$;

for heat production, in the initial state, $G_T$ is maintained in the evaporator (Evap) at low temperature by heat exchange with the cold source at $T_{lo}$, $G_T$ is maintained in the condenser (Cond) at a temperature $T_{hi} \geq T_{lo}$ by heat exchange with a medium external to the machine, said medium having initially a temperature greater than or equal to $T_{hi}$; and, in the steady state, net work is consumed by the hydraulic pump (HP), the cold source at $T_{lo}$ continuously supplies heat to the evaporator (Evap), the condenser (Cond) continuously removes heat to the hot sink, the plant producing heat to the external medium in contact with said condenser (Cond), the external medium having a temperature $T_{hi} > T_{lo}$.

30. A method for managing a plant as claimed in claim 4, starting from an initial state in which all the communication circuits for the working fluid $G_T$ and for the transfer liquid $L_T$ are closed off, wherein, at time $t_0$, the hydraulic pump (HP) is actuated and the $G_T$ circuit between (Cond) and (Evap) is opened, and $G_T$ is subjected to a succession of modified Carnot cycles, each of which comprising the following steps:

at time $t_\alpha$, the $L_T$ circuit for transferring $L_T$ from the chamber (CT) to the chamber (CT') passing via the hydraulic pump (HP is opened and the $G_T$ circuit between Evap and (CT) is opened, so that:

$L_T$ is taken in by the pump HP, which pressurizes it and delivers it into (CT');

the $L_T$ level in (CD passes from high to an intermediate level J, and in (CT') from low to an intermediate level I;

because the volume occupied by the $G_T$ vapor in (CT) increases, $G_T$ evaporates in Evap and the saturated $G_T$ vapor leaving Evap at the low pressure $P_{lo}$ enters (CT);

the $G_T$ vapor contained in (CT') is adiabatically compressed up to the high pressure $P_{hi}$; and $G_T$ in the saturated or supercooled liquid state in (Cond) and at the high pressure $P_{hi}$ expands isenthalpically and is introduced in the liquid/vapor two-phase mixture state and at the low pressure $P_{lo}$ into the evaporator (Evap);

at time $t_\beta$, the $G_T$ circuit between (CT') and (Cond) is opened so that:

$L_T$ is again taken up by the pump HP, which pressurizes it and delivers it into (CT');

the $L_T$ level in (CT) passes from the intermediate level J to low, and in (CT') from the intermediate level I to high;

because the volume occupied by the $G_T$ vapor in (CT) continues to increase, $G_T$ evaporates in (Evap) and the saturated $G_T$ vapor leaving (Evap) at the low pressure $P_{lo}$ enters (CT); and the $G_T$ vapor contained in (CT'), at high pressure $P_{hi}$, is delivered by $L_T$ into and condenses in (Cond);

at time $t_\gamma$, all the circuits open at time $t_\beta$, except for the $G_T$ circuit between (Cond) and (Evap), are closed, the $L_T$ circuit for transferring $L_T$ from (CT') to (CT) passing via the hydraulic pump (HP) is opened and the $G_T$ circuit between (Evap and (CT') is opened so that:

$L_T$ is taken in by the pump (HP), which pressurizes it and delivers it into (CT);

the $L_T$ level in (CT) passes from low to an intermediate level I, and in (CT') from high to an intermediate level J;

since the volume occupied by the $G_T$ vapor in (CT') increases, the working fluid $G_T$ evaporates in (Evap) and the saturated $G_T$ vapor leaving (Evap) at the low pressure $P_{lo}$ enters (CT');

the $G_T$ vapor contained in (CT) is adiabatically compressed up to the high pressure $P_{hi}$; and $G_T$ in the saturated or supercooled liquid state in (Condv and at the high pressure $P_{hi}$ expands isenthalpically and is introduced in the liquid/vapor two-phase mixture state and at the low pressure $P_{lo}$ into the evaporator (Evap); and at time $t_\delta$ the $G_T$ circuit between (CTv and (Cond) is opened so that:

$L_T$ is again taken in by the pump (HP), which pressurizes it and delivers it into (CT);

the $L_T$ level in (CT) passes from the intermediate level I to high and in (CT') from the intermediate level J to low;

because the volume occupied by the $G_T$ vapor in (CT') continues to increase, $G_T$ evaporates in (Evap) and the saturated $G_T$ vapor leaving (Evap) at the low pressure $P_{lo}$ enters (CT'); and the $G_T$ vapor contained in (CT), at high pressure $P_{hi}$, is delivered by $L_T$ into and condenses in (Cond), wherein, after several cycles, the plant operates in a steady state, and that:

for refrigeration: in the initial state, $G_T$ is maintained in the condenser (Cond) at high temperature by heat exchange with the hot sink at $T_{hi}$ and in the evaporator (Evap) at a temperature equal to or below $T_{hi}$ by heat exchange with a medium external to the machine, said medium having initially a temperature greater than or equal to $T_{hi}$; and, in the steady state, net work is consumed by the hydraulic pump (HP), the condenser (Cond) continuously removes heat to the hot sink at high temperature $T_{hi}$ and heat is continuously consumed by the evaporator (Evap), that is to say there is extraction of heat from the external medium in contact with said evaporator (Evap), the temperature $T_{lo}$ of said external medium being $< T_{hi}$; and for heat production: in the initial state, $G_T$ is maintained in the evaporator (Evap) at low temperature by heat exchange with the cold source at $T_{lo}$ and in the condenser (Cond) at a temperature $\geq T_{hi}$ by heat exchange with a medium external to the plant at a temperature $\geq T_{hi}$; and, in the steady state, net work is consumed by the hydraulic pump HP, the cold source at $T_{lo}$ supplies heat continuously to (Evap), and (Cond) continuously removes heat to the hot sink, that is to say there is production of heat in the external medium in contact with (Cond), the temperature $T_{hi}$ of said external medium being above $T_{lo}$.

* * * * *

UNITED STATES PATENT AND TRADEMARK OFFICE

CERTIFICATE OF CORRECTION

PATENT NO. : 8,794,003 B2
APPLICATION NO. : 12/935474
DATED : August 5, 2014
INVENTOR(S) : Mauran et al.

It is certified that error appears in the above-identified patent and that said Letters Patent is hereby corrected as shown below:

In the Claims

Column 39, Claim 14, Line 35: The term --G(sub)T-- should be inserted between the words “barrier” and “between”

Column 42, Claim 28, Line 64: The term --(CT')-- should be inserted between the words “in” and “continues”

Column 43, Claim 29, Line 56: The term “P(sub)h” between the words “pressure” and “to” should read as “P(sub)h(sub)i”

Column 44, Claim 29, Line 29: The word “dosed,” between the words “are” and “the” should read as “closed,”

Column 44, Claim 29, Line 52: The term --G(sub)T-- should be inserted between the words “the” and “vapor” instead of “1”

Column 44, Claim 29, Line 63: The term --L(sub)T-- should be inserted before the word “is”

Column 45, Claim 29, Line 18: The term --HP,-- should be inserted between the words “pump” and “the”

Signed and Sealed this
Ninth Day of December, 2014

Michelle K. Lee

Michelle K. Lee
*Deputy Director of the United States Patent and Trademark Office*